US006955016B1

(12) United States Patent
Churches et al.

(10) Patent No.: US 6,955,016 B1
(45) Date of Patent: Oct. 18, 2005

(54) STRUCTURE AND METHOD FOR CONSTRUCTING BUILDING FRAMEWORK AND CONCRETE WALL

(75) Inventors: Charles H. Churches, Claysville, PA (US); Anthony Scavo, Brooklyn, NY (US)

(73) Assignee: Lefrak Organization, Inc., Forest Hills, NY (US)

( * ) Notice: Subject to any disclaimer, the term of this patent is extended or adjusted under 35 U.S.C. 154(b) by 905 days.

(21) Appl. No.: 08/883,387

(22) Filed: Jun. 26, 1997

(51) Int. Cl.[7] ..... E04H 1/02

(52) U.S. Cl. ..... 52/236.3; 52/79.2; 52/251; 52/274; 52/293.1; 52/745.12

(58) Field of Search ..... 52/236.3, 236.4, 52/236.6, 250, 251, 252, 264, 274, 223.6, 292, 293.1, 293.3, 299, 741.13, 745.05, 745.08, 745.09, 745.1, 745.12, 79.1, 79.2, 79.9

(56) References Cited

U.S. PATENT DOCUMENTS

| | | | | | |
|---|---|---|---|---|---|
| 2,083,987 | A | * | 6/1937 | Davis | 52/236.6 X |
| 2,091,061 | A | * | 8/1937 | Waugh | 52/251 |
| 3,350,826 | A | * | 11/1967 | Hughes | 52/293.1 |
| 3,535,841 | A | * | 10/1970 | Lorenz et al. | 52/236.6 |
| 3,706,168 | A | * | 12/1972 | Pilish | 52/234 |
| 3,772,835 | A | * | 11/1973 | Cox et al. | 52/79.11 |
| 3,948,008 | A | * | 4/1976 | Goetz | 52/251 |
| 4,000,589 | A | | 1/1977 | Bianchini | |
| 4,058,944 | A | | 11/1977 | Rieger | |
| 4,127,971 | A | * | 12/1978 | Rojo, Jr. | 52/79.11 |
| 4,142,335 | A | | 3/1979 | Andrade | |
| 4,145,861 | A | * | 3/1979 | Yarnick | 52/293.11 |
| 4,157,638 | A | | 6/1979 | Della-Donna | |
| 4,170,857 | A | | 10/1979 | Rieger | |
| 4,398,378 | A | * | 8/1983 | Heitzman | 52/251 |
| 4,461,130 | A | * | 7/1984 | Shubow | 52/236.8 |
| 4,557,089 | A | | 12/1985 | Breithaupt | |
| 4,691,490 | A | | 9/1987 | Leaver | |
| 4,765,103 | A | | 8/1988 | Clarke | |
| 4,901,491 | A | | 2/1990 | Phillips | |
| 4,905,444 | A | | 3/1990 | Semaan et al. | |
| 4,974,380 | A | | 12/1990 | Bernander et al. | |
| 5,014,476 | A | | 5/1991 | Leslie et al. | |
| 5,038,541 | A | | 8/1991 | Gibbar, Jr. | |

(Continued)

*Primary Examiner*—Winnie Yip
(74) *Attorney, Agent, or Firm*—Louis J. Hoffman; Peter C. Warmer

(57) ABSTRACT

A self-supporting shearwall structure in the form of an "H," an "I," or a "C" is disclosed. The shearwall structure provides vertical and lateral support to the framework of a multi-story building sufficient to support the roof, other exterior and/or interior walls, and intermediate floor loads of the building, as well as the wind load of the building. In the preferred embodiment, the wall structure is made primarily of reinforced concrete, preferably comprising pre-cast concrete panels. The panels are placed end to end on their edge on the first (or lowest) floor of the building and joined to the building's foundation and to at least one other horizontally adjoining panel. The structure is made higher by adding an additional row of panels horizontally aligned at vertical support points and placed on their edge on top of the row of panels that has already been formed such that each subsequent row of panels is supported on and grouted to the prior row. Horizontal floors connected to the shearwalls at various elevations of the building act as stiffening elements providing diaphragm action to the shearwalls. Additional rows of panels and floors are added until the desired height of the building is achieved. Vertical columns, vertical beams, walls, stairwells and elevator shafts forming the framework of the building are included in the structure as desired for functionality. The structure may provide lateral support for one or more attached vertically self-supporting exterior walls.

129 Claims, 19 Drawing Sheets

U.S. PATENT DOCUMENTS 5,152,114 A 10/1992 Beazley et al.
5,351,454 A 10/1994 Hähne et al.
5,353,560 A 10/1994 Heydon
5,487,241 A 1/1996 Gorrell et al.
5,509,249 A 4/1996 House et al.
5,515,659 A 5/1996 MacDonald et al.
5,528,866 A 6/1996 Yulkowski
5,678,372 A * 10/1997 Thomson et al. ..... 52/432

* cited by examiner

STRUCTURE AND METHOD FOR CONSTRUCTING BUILDING FRAMEWORK AND CONCRETE WALL

BACKGROUND

Concrete has been used in construction for over 2,000 years, perhaps first by the Romans in their aqueducts and roadways. The Romans used a primitive mix for their concrete. Mortar consisted of small gravel and coarse sand mixed together with hot lime and water. They used horse hair, much like polypropylene fibers are used today, to reduce shrinkage. They even unintentionally entrained the air in the mix by adding animal blood. That process created small air bubbles in concrete, making the mix more durable. While the Romans stopped building concrete aqueducts long ago, concrete is used extensively today throughout the building industry, including high-rise building construction.

As a result of functional and aesthetic demands of owners and/or inhabitants that are ever changing and more demanding, new building structures continue to get larger, both in terms of ground area and height. As these structures get larger, so has the recognition of potential damage and destruction that may be caused to them as a result of natural disasters (e.g., earthquakes or wind storms) or man-made disasters (e.g., bombings). Accordingly, building code requirements today are more stringent than ever before. Advances are continually being made in building design, material, and construction methods to keep up with these demands. Despite these advances, costs incurred in constructing high-rise structures continue to escalate.

A feature common to high-rise structures is the interdependency of the outside and interior walls and framework to the structural integrity and stability of the overall building. Namely, the interior walls, vertical columns, vertical beams and/or floor planks of these structures rely, in part, on exterior vertical columns, vertical beams and/or walls for lateral and vertical support, and vice versa. As a result, damage to an exterior wall can threaten the integrity of the entire structure. If, however, the exterior walls are vertically self-supported and the interior framework of the structure is not dependent on the exterior walls for vertical or lateral support, a percussion (e.g., bomb blast, wind gust, etc.) to the exterior of structure will be primarily absorbed by the exterior walls, while the interior framework and walls will be relatively unaffected by the percussion. In that case, although one or more exterior wall may be damaged or destroyed, any damage to the integrity of the internal framework will be minimized.

Another feature common to these structures is the use of steel vertical beams and vertical columns to support not only the lateral loads of exterior walls, but also the vertical loads of the exterior walls. The use of such vertical beams and vertical columns adds greatly to the material and labor cost of construction.

An example of a low-rise structure that utilizes exterior walls that do not rely on interior vertical beams, vertical columns or walls for vertical support is described in U.S. Pat. No. 4,691,490. That patent purports to describe an exterior building wall comprised of vertically self-supporting modular concrete panels that are arranged and stacked together. The wall relies on the adjacent framework for lateral support. However, in the described invention, window or door components may be substituted for the modular concrete panels. No known window or door components, in and of themselves, could support the tons of vertical load support that would be necessary in a vertically self-supporting high-rise wall. Likewise, in the system described in U.S. Pat. No. 4,691,490, the concrete panels described are just that, concrete panels. No reinforcement for the concrete panels beyond the use of self-contained styrofoam battens is described, again evidencing the use of that invention only in low-rise structures. Further, no provision is made for concrete panels that incorporate openings for windows, doors and/or appliances, and/or have portions of the concrete panels that project out or recess in from the support plane of the wall.

Accordingly, there is a need for a high-rise structure whose interior walls and framework are not dependent on exterior walls or framework for lateral or vertical support. Correspondingly, there is a need for a high-rise structure whose exterior walls and framework are not dependent on interior walls or framework for vertical support. There is also a need for such exterior walls that incorporate openings for windows, doors and/or appliances, and/or have portions of the panels that project out or recess in from the support plane of the wall. Correspondingly, there is also a need for a method and materials for constructing such structures.

OBJECTS OF THE INVENTION

It is an object of this invention to provide a new and improved building structure capable of lateral and vertical support without the need of lateral support from exterior walls or framework.

It is a further object of this invention to provide a new and improved reinforced concrete structure capable of lateral and vertical support without the need of lateral support from exterior walls or framework.

It is yet a further object of the present invention to provide a new and improved vertically self-supported exterior wall for high-rise structures wherein only lateral loading normal to the plane of the wall need be carried by the adjacent framework.

It is yet a further object of the present invention to provide a new and improved vertically self-supported monolithic wall comprised of reinforced concrete for use in high-rise structures wherein only lateral loading normal to the plane of the wall need be carried by the adjacent framework.

It is yet a further object of the present invention to provide a new and improved method for constructing monolithic concrete wall structures from prefabricated reinforced concrete panels.

It is yet a further object of the present invention to provide a new and improved vertically self-supported monolithic wall comprised of reinforced concrete and for use in high-rise structures wherein the wall is formed primarily from prefabricated reinforced concrete panels that are assembled into the wall structure on the building site.

It is yet a further object of the present invention that the exterior and/or interior shearwalls incorporate openings for windows, doors and/or appliances.

It is yet a further object of the present invention that the exterior have portions of the walls that project out or recess in from the support plane of the wall.

SUMMARY OF INVENTION

The above and other objects are achieved in the present inventions, which provide a new and improved building structure wherein a vertical central shearwall is integral with two vertical end shearwalls. The end shearwalls are arranged normal to the central shearwall or framework. The base of each of the three shearwalls, in turn, is integral with the foundation of the structure. As such, in the preferred embodiment, these walls provide lateral support for the remaining internal framework of the structure, as well as provide directly, and/or indirectly through other internal framework members, lateral support for the external walls and/or framework of the structure. Horizontal floors connected to the shearwalls at various elevations of the building act as stiffening elements providing diaphragm action to the shearwalls. In other embodiments, the shearwalls directly and/or indirectly provide lateral and vertical support for the remaining framework of the structure.

The above and other objects are also achieved in an embodiment wherein one or more of the internal shearwalls and/or one or more of the exterior walls is comprised of a monolithic reinforced concrete structure. It is possible to frame and cast the concrete wall or walls on site using standard building techniques. However, in the preferred embodiment, prefabricated reinforced concrete panels are stood vertically, aligned end-to-end on their vertical edges, aligned and stacked top-to-bottom on their horizontal edges, and joined together along the adjacent edges. Use of the prefabricated panels significantly reduces the time, labor and expense normally associated with framing steel reinforcing bars, or rebars, and pouring concrete on the actual building site perhaps stories above the ground. Instead, finished panels are taken to the job site and simply hoisted into place and joined together to form the walls of the structure.

In the exterior walls, approximately ¾ of an inch generally separates the vertical edges of adjacent panels. Any space between vertical edges of horizontally aligned panels is filled with grout. Horizontally adjacent panels are then braced together and/or to members of the internal framework of the structure. In the preferred embodiment, the bracing is accomplished with brackets bolted or otherwise affixed into the panels and adjacent internal framework.

In the shearwalls, hairpin rebars extend from the vertical edges of the panels. The rebar from adjacent panels is spaced vertically so as not to touch each other. The panels are placed close enough to each other such that straight rebars may be vertically run through the loops formed by the hairpin rebars of adjacent panels. The voids between adjacent panels are then grouted with concrete to form a horizontally monolithic reinforced concrete wall.

For the lowest floor of panels, shims approximately ¾ inches high are placed on the foundation at points approximating the location where the corners of panels will be placed. Panels are then placed at pre-determined points on the foundation such that reinforcement bars in the foundation are matched to and coupled with reinforcement bars running vertically through the panels. The space between the foundation and the wall of panels is then grouted to form a monolithic structure between the foundation and the wall panels.

Additional levels of panels are added following the same procedure. Namely, shims approximately ¾ inches high are placed on the top corners of a panels where a new level of panels will be placed. New panels are then placed at pre-determined points on top of the highest existing level of panels such that reinforcement bars in the lower floor are matched to and coupled with reinforcement bars running vertically through the upper panels. The space between the upper and lower wall of panels is then grouted to form a monolithic structure between vertically stacked panels. Accordingly, all of the vertical panels so joined are also monolithic with the foundation of the structure.

The above and other objects of the invention are accomplished in the preferred embodiment, by incorporating openings into the panels for windows, doors and/or appliances while a plurality of reinforcement bars of vertically aligned panels remain vertically coupled and monolithic. Similarly, as long as such alignment is maintained, alternative embodiments of the invention may include exterior walls that have portions of the panels that project out or recess in from the support plane of the wall, thereby accomplishing yet another goal of the invention.

The preferred embodiment of the inventions is described below in the Figures and Detailed Description. Unless specifically noted, it is intention of the inventor that the words and phrases in the specification and claims be given the ordinary and accustomed meaning to those of ordinary skill in the applicable art(s). If the inventor intends any other meaning, he will specifically state that he is applying a special meaning to a word or phrase.

Likewise, the use of the words "function" or "means" in the Detailed Description is not intended to indicate a desire to invoke the special provisions of 35 U.S.C. Section 112, ¶6 to define his invention. To the contrary, if the provisions of U.S.C. Section 112, ¶6 are sought to be invoked to define the inventions, the claims will specifically state the phrases "means for" or "step for" and a function, without also reciting in that phrase any structure, material or act in support of the function. Even if the claims recite a "means for" or "step for" performing a function, if they also recite any structure, material or acts in support of that means of step, then the intention is not to invoke the provisions of 35 U.S.C. Section 112, ¶6. Moreover, even if the inventors invoke the provisions of 35 U.S.C. Section 112, ¶6 to define inventions, it is the intention that the invention not be limited only to the specific structure, material or acts that are described in his preferred embodiments. Rather, in claims specifically invoking the provisions of 35 U.S.C. Section 112, ¶6, it is the intention to cover and include any and all structures, materials or acts that perform the claimed function, along with any and all known or later developed equivalent structures, materials or acts for performing the claimed function.

For example, various coupling and connecting devices are shown and referenced throughout the specification. It is intended that any appropriate or conventional coupling and connecting device can be substituted, as long as it can maintain the integrity of the brace or connection being made at the location shown. In addition, applicant discloses a preferred embodiment based on a desired building size. However, all dimensions provided are approximate and not exact, and may be changed without departing from the spirit and scope of the invention. Other examples exist throughout the disclosure, and it is not applicant's intention to exclude from the scope of his inventions the use of structures, materials or acts that are not expressly identified in the specification, but nonetheless capable of performing expressed functions.

BRIEF DESCRIPTION OF DRAWINGS

The inventions of this application are better understood in conjunction with the following drawings and detailed description of the preferred embodiment.

Figure 8:
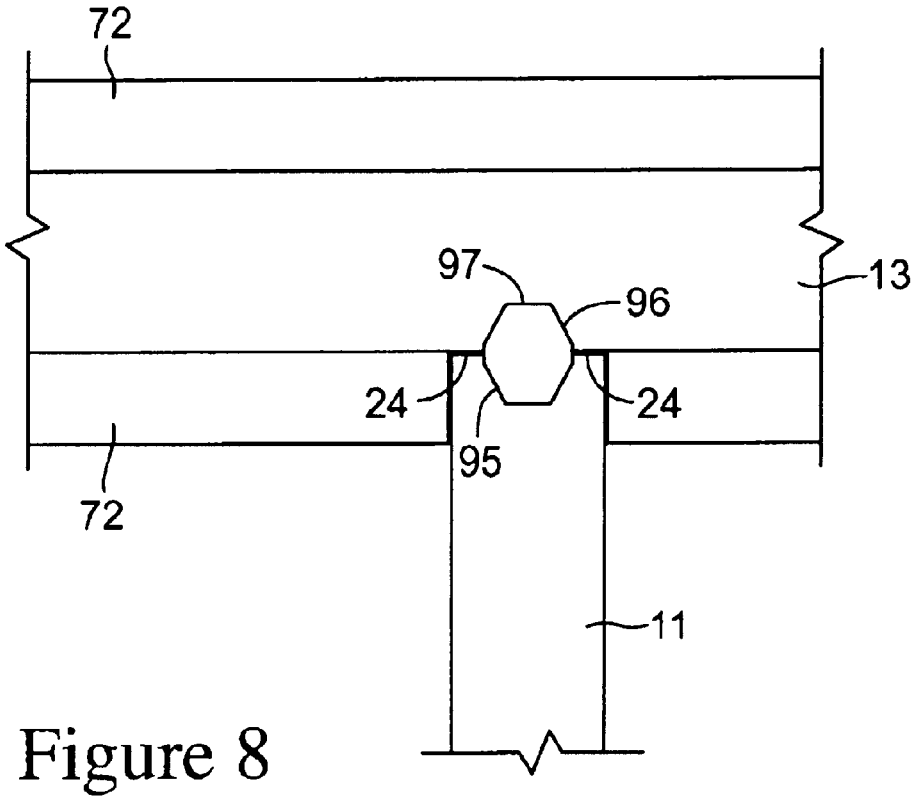
FIG. 8 is a plan section view of the arrangement of the end of the center shearwall to an end shearwall.
Figure 8A:
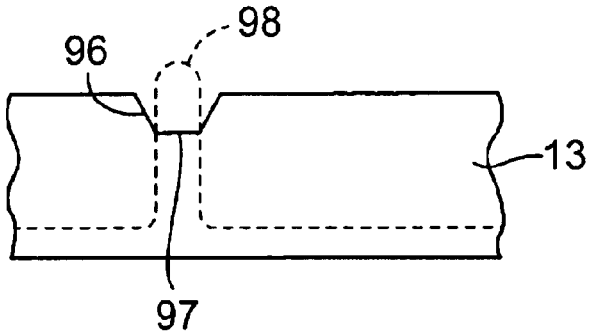

The FIG. 8A is a plan section view of the arrangement of the hairpin rebars in the end shearwall that are coupled to the center shearwall.

Figure 9:
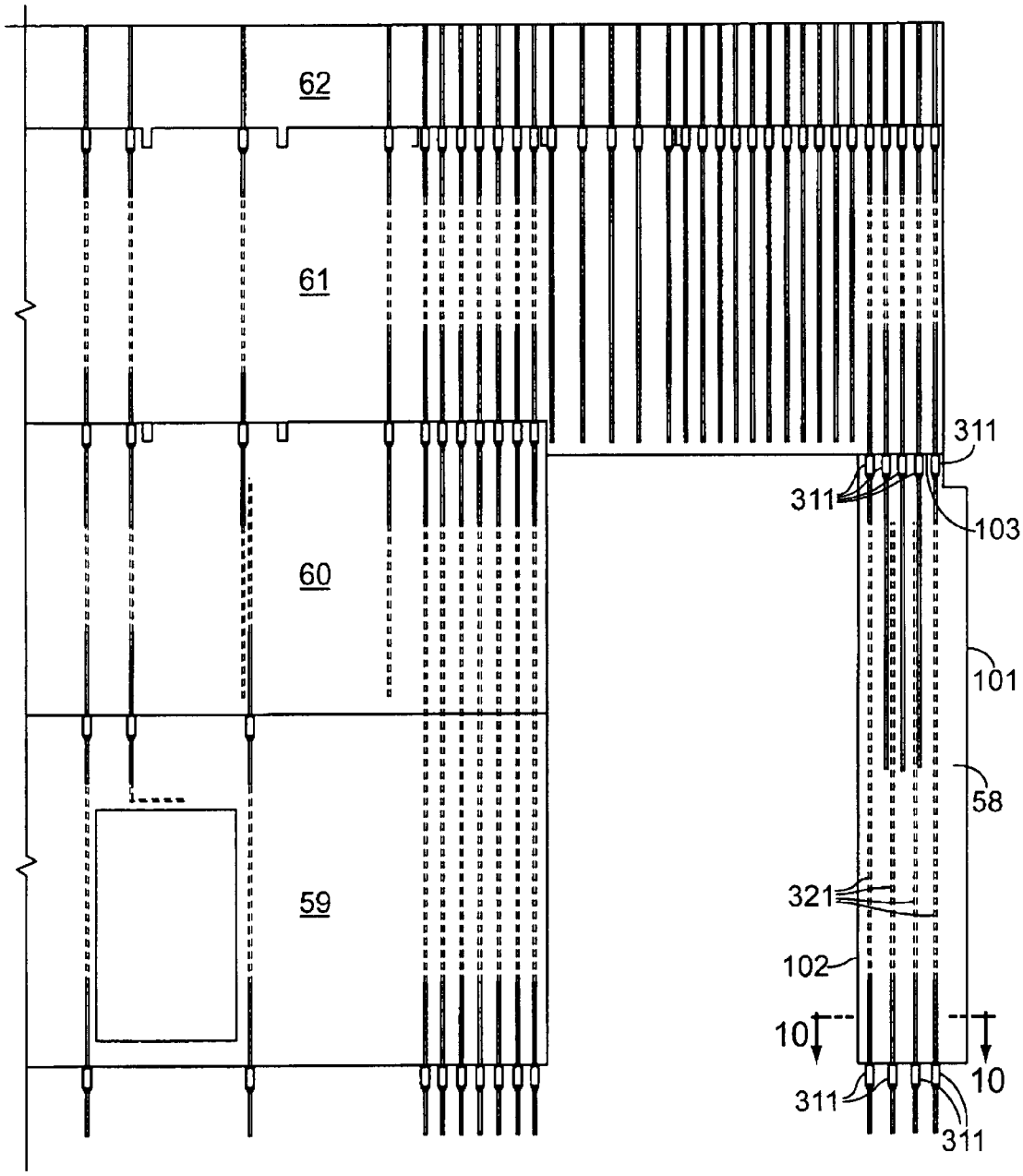

FIG. 9 is an elevation view of a reinforced concrete column on the foundation at the end of end shearwall 12 and the shearwall panels next to or near the column.

Figure 10:
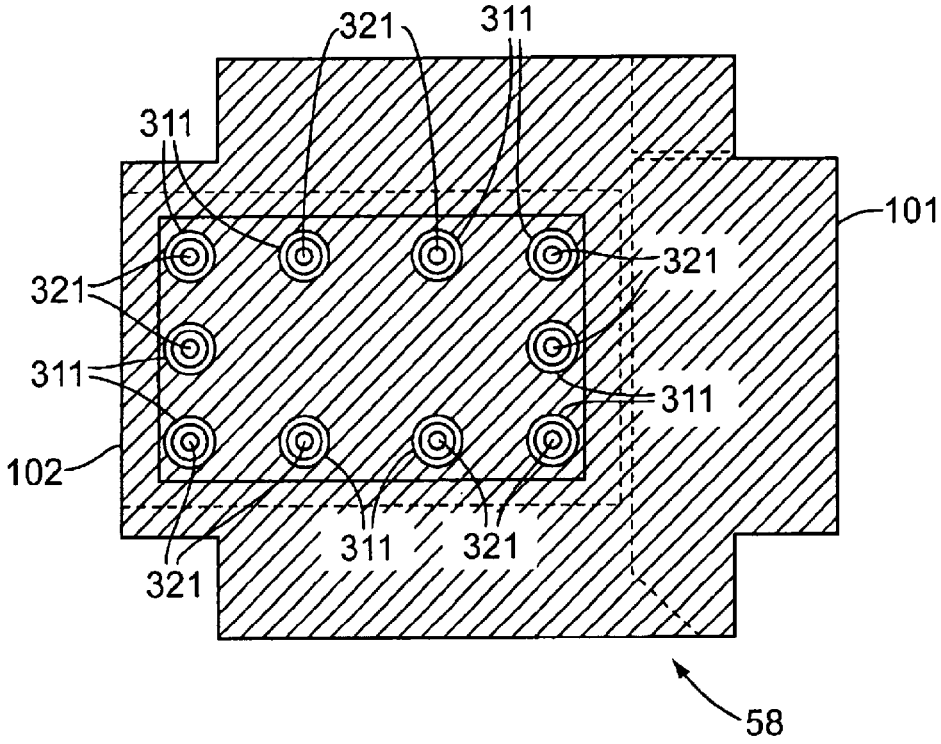

FIG. 10 is a top plan section view of the reinforced concrete column shown in FIG. 9.

Figure 11:
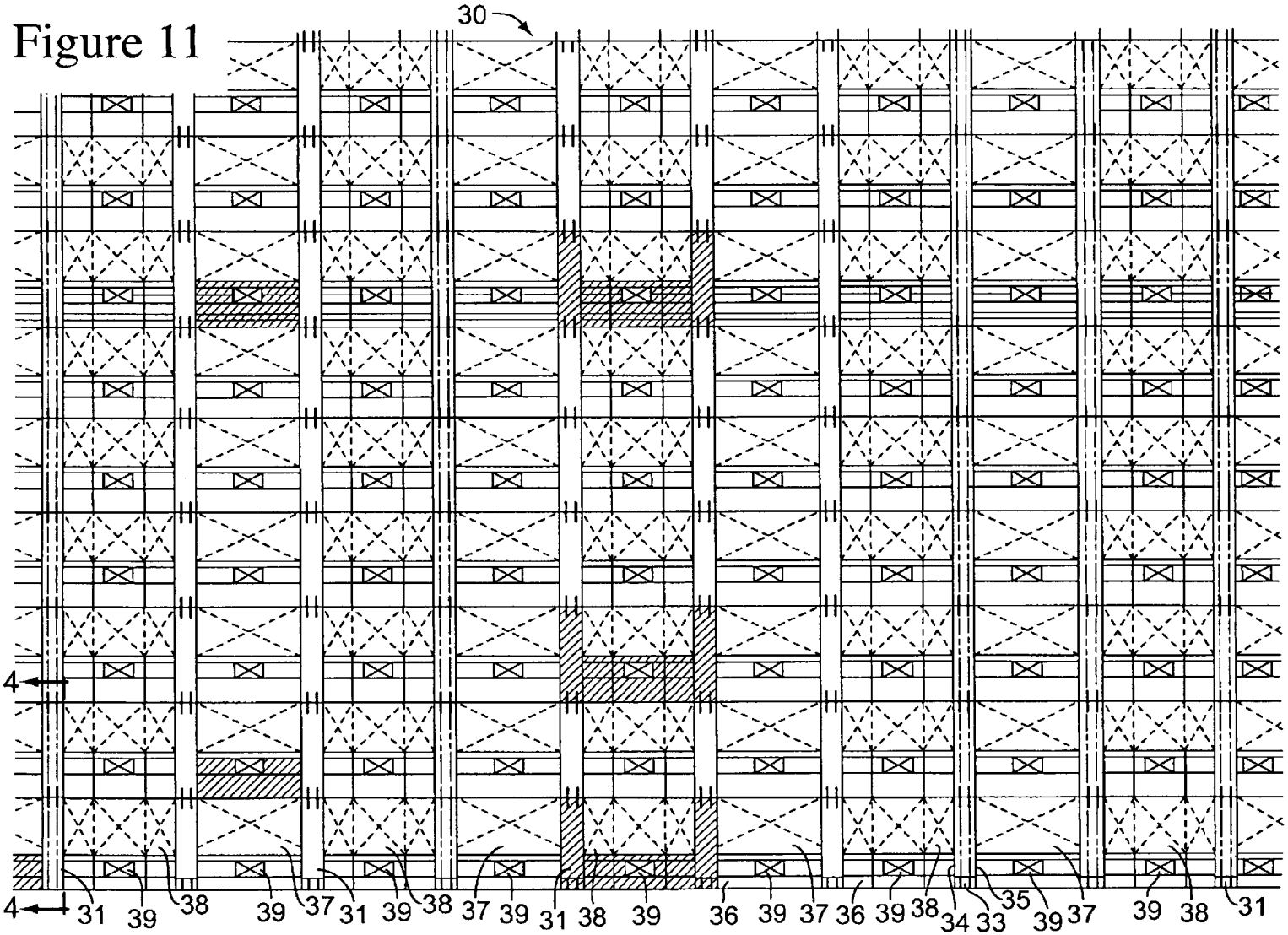

FIG. 11 is an elevation view of a portion of a vertically self-supporting reinforced concrete exterior wall.

Figure 12:
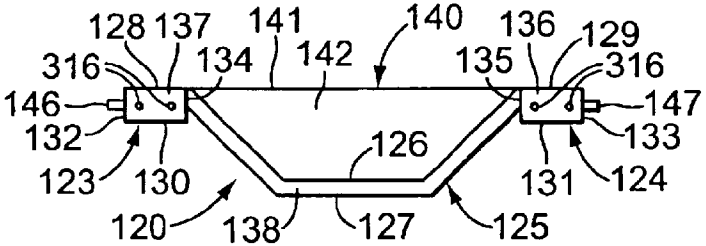

FIG. 12 a plan view of a typical reinforced concrete bay panel in the vertically self-supporting reinforced concrete exterior wall shown in FIG. 11.

Figure 13:
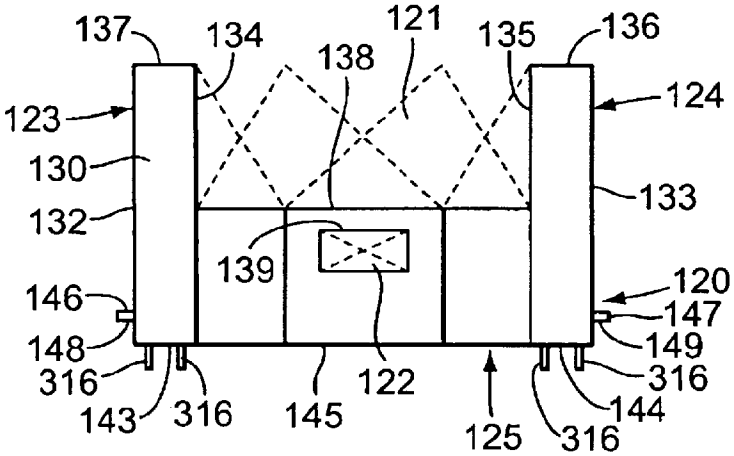

FIG. 13 is an elevation view of the bay panel shown in FIG. 12.

Figure 14:
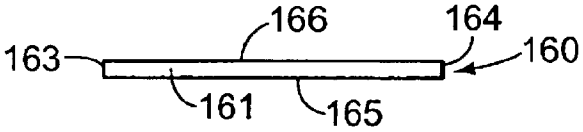

FIG. 14 a plan view of a typical reinforced concrete flat panel in the vertically self-supporting reinforced concrete exterior wall shown in FIG. 11.

Figure 15:
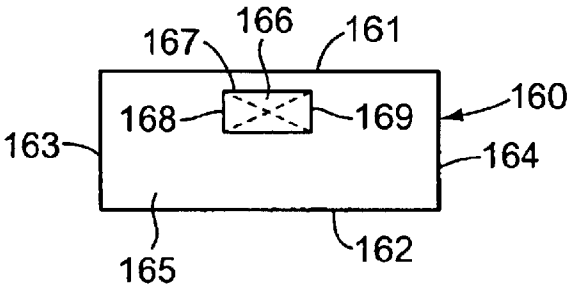

FIG. 15 is an elevation view of the flat panel shown in FIG. 14.

Figure 16:
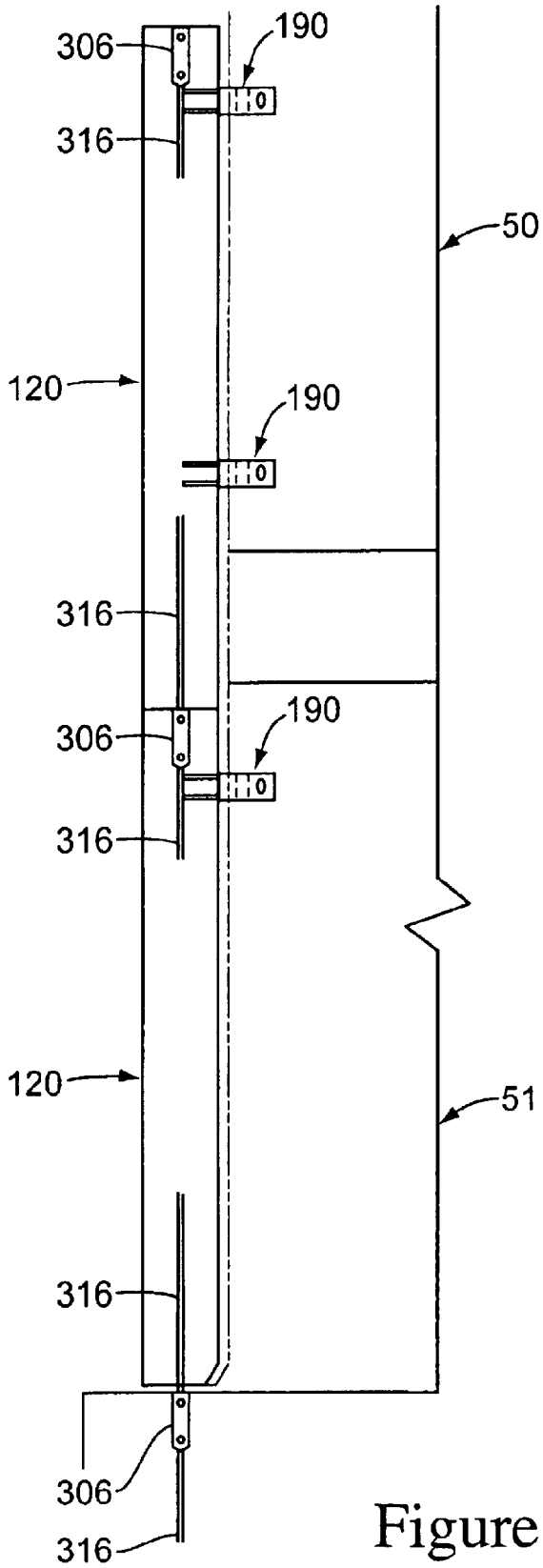

FIG. 16 is a side section view of a bay panel column, the foundation and one full shearwall panel level and the bottom portion of a second shearwall panel level on one side of the shearwall along the line 4—4 of FIG. 11.

Figure 17:
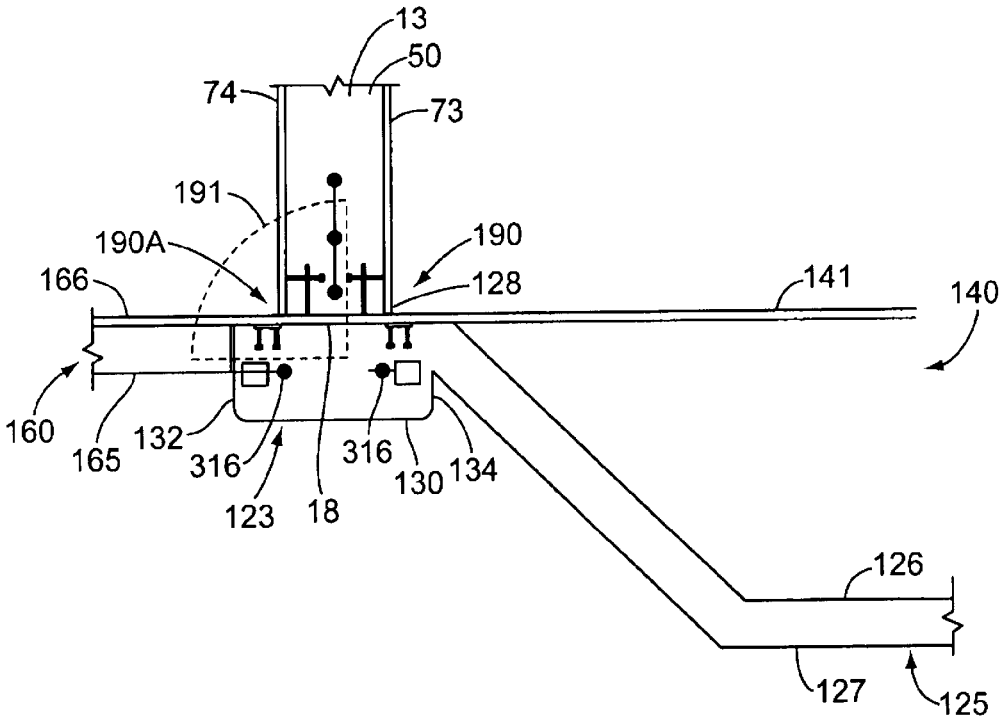

FIG. 17 is a top plan section view of a portion of the bay panel column, the shearwall, and two of the brackets coupling the bay panel column to the shearwall.

Figure 18:
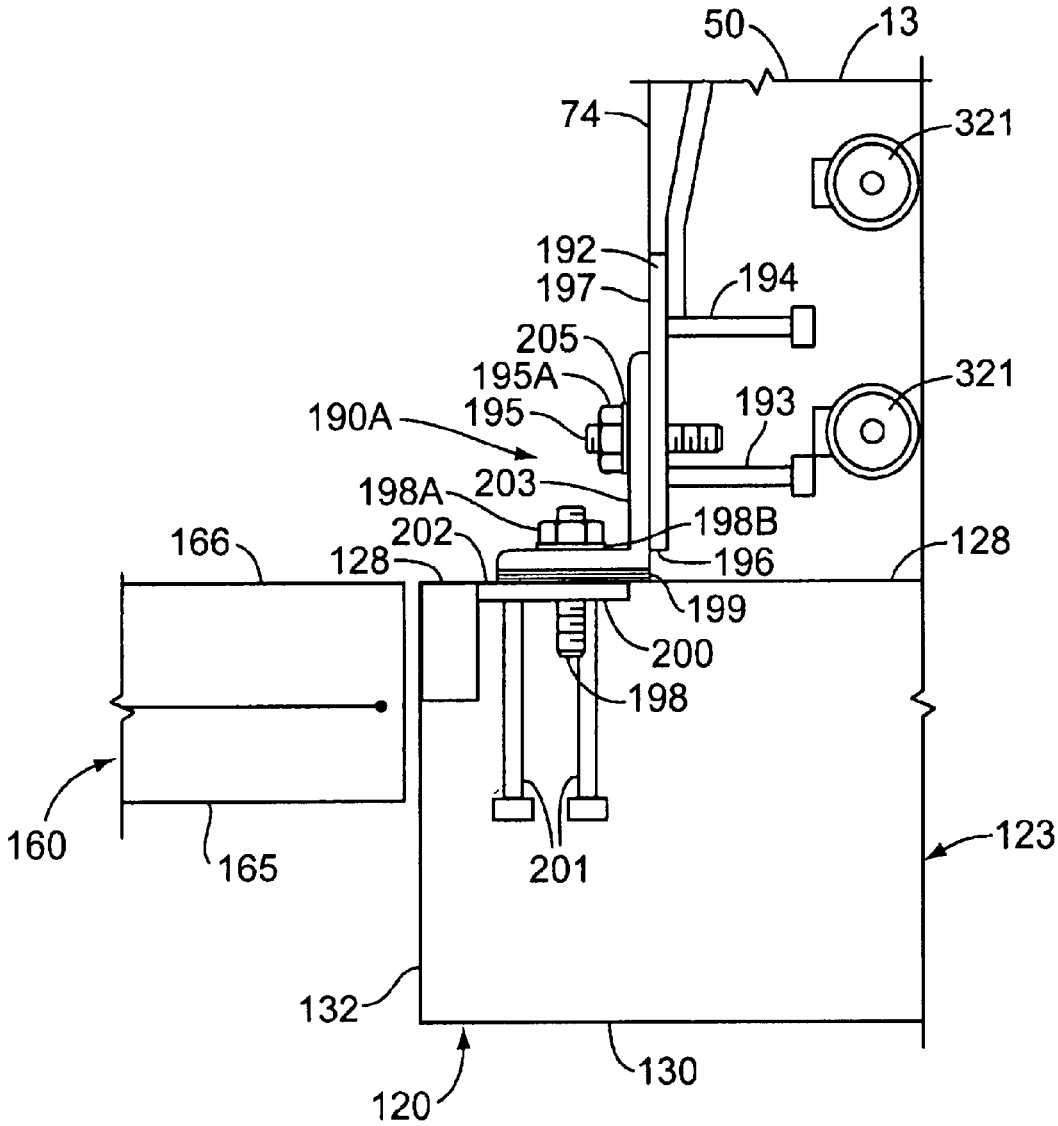

FIG. 18 is a detail top plan section view of one the brackets coupling the bay panel column to the shearwall.

Figure 19:
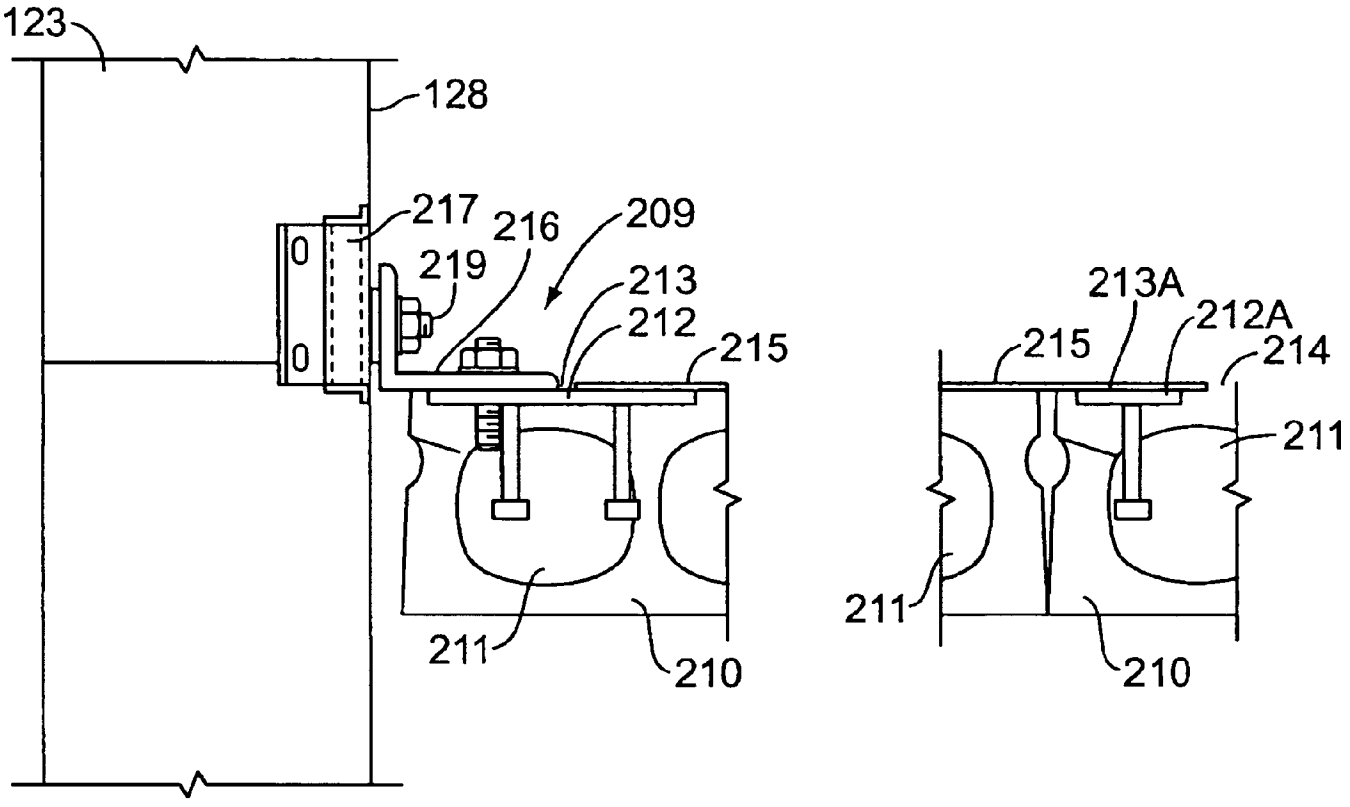

FIG. 19 is the side view of a bay panel column coupled to 12 inch thick floor planks.

Figure 19A:
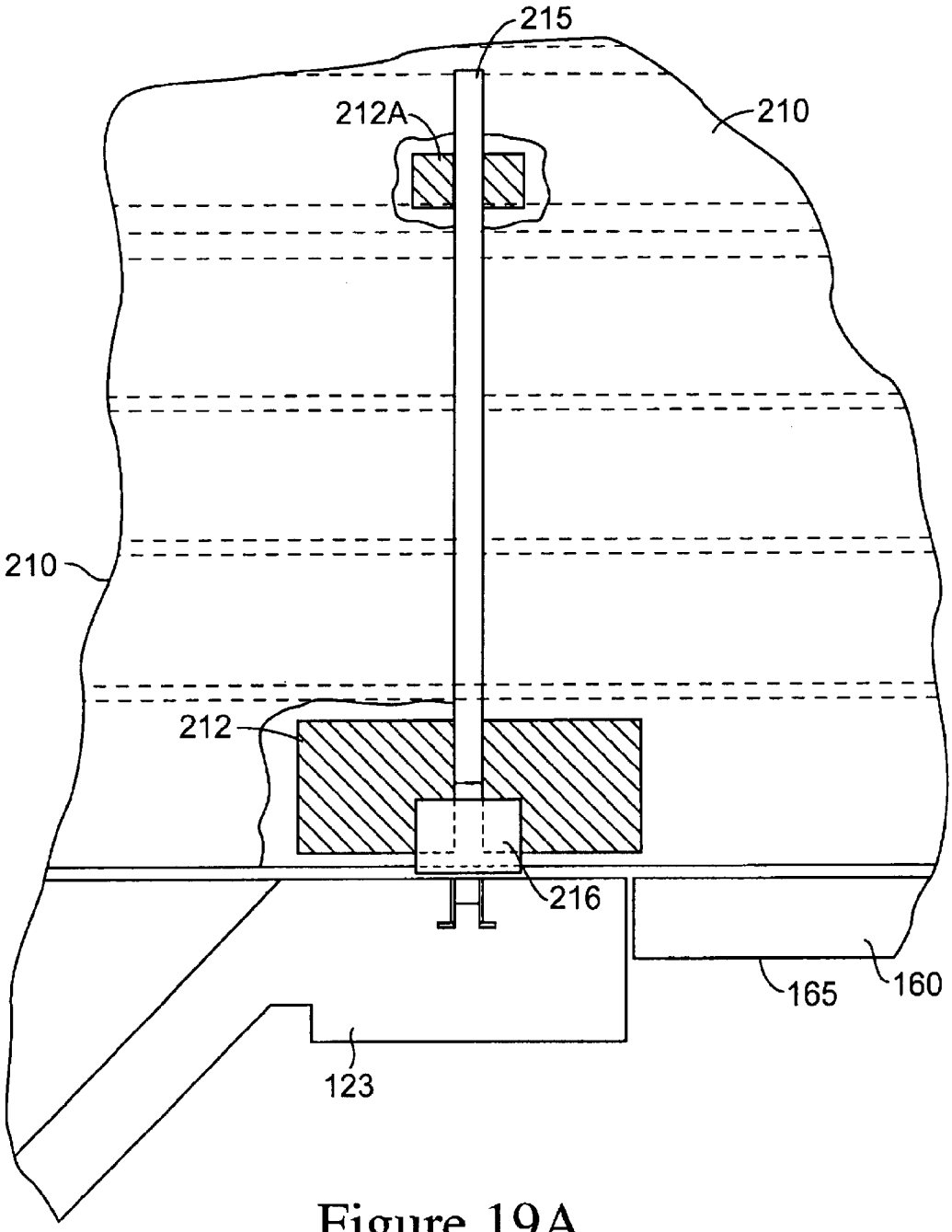

FIG. 19A is the top plan view of a bay panel column coupled with a strap plate to 12-inch thick floor planks.

Figure 2:
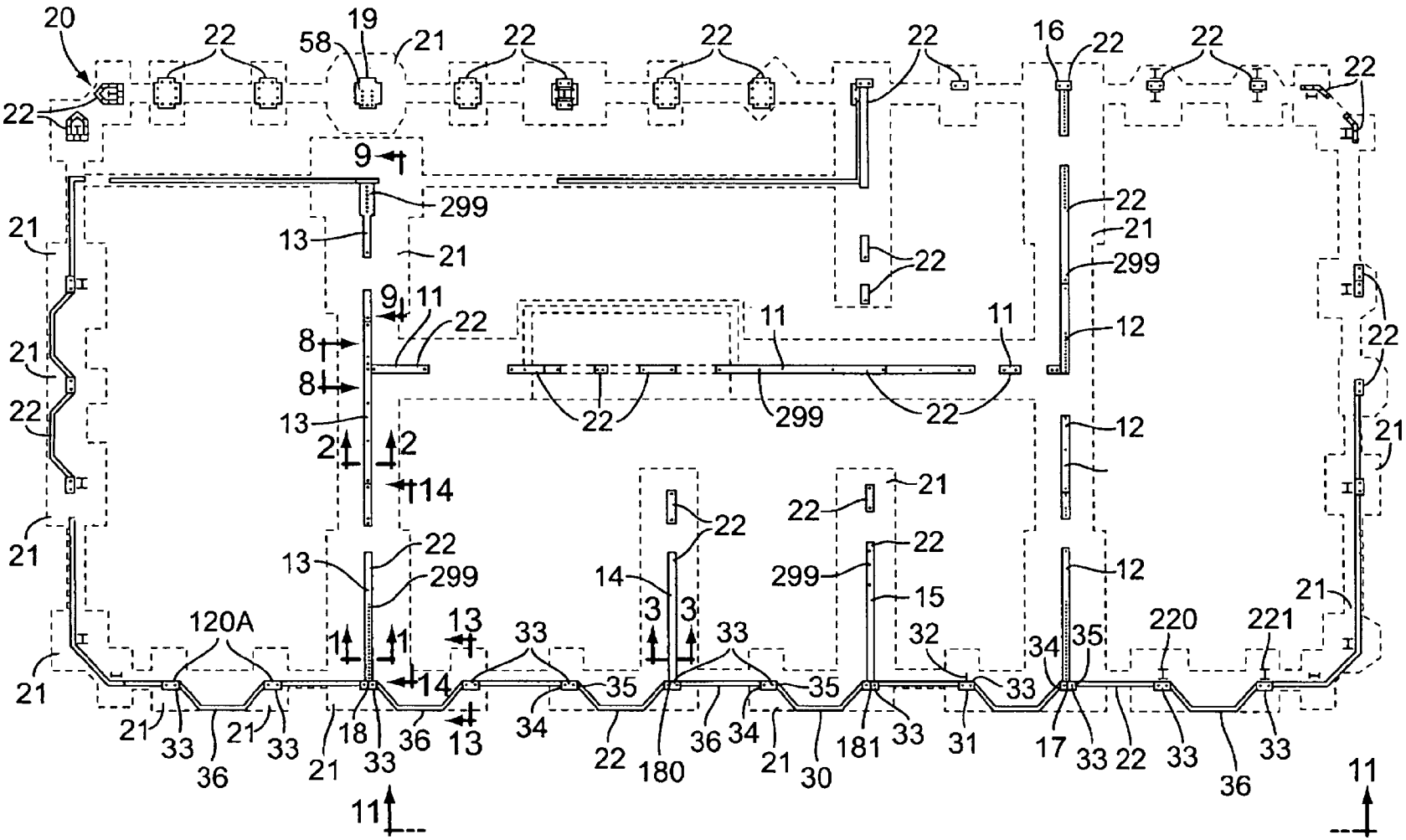
FIG. 2 is a top plan view of the foundation of the structure upon which the structure is built. The reinforced concrete footings of the foundation are shown within the dashed borders of FIG. 2. The solid lines show a plan view of the first level of framework of the building coupled to the foundation 20.
Figure 20:
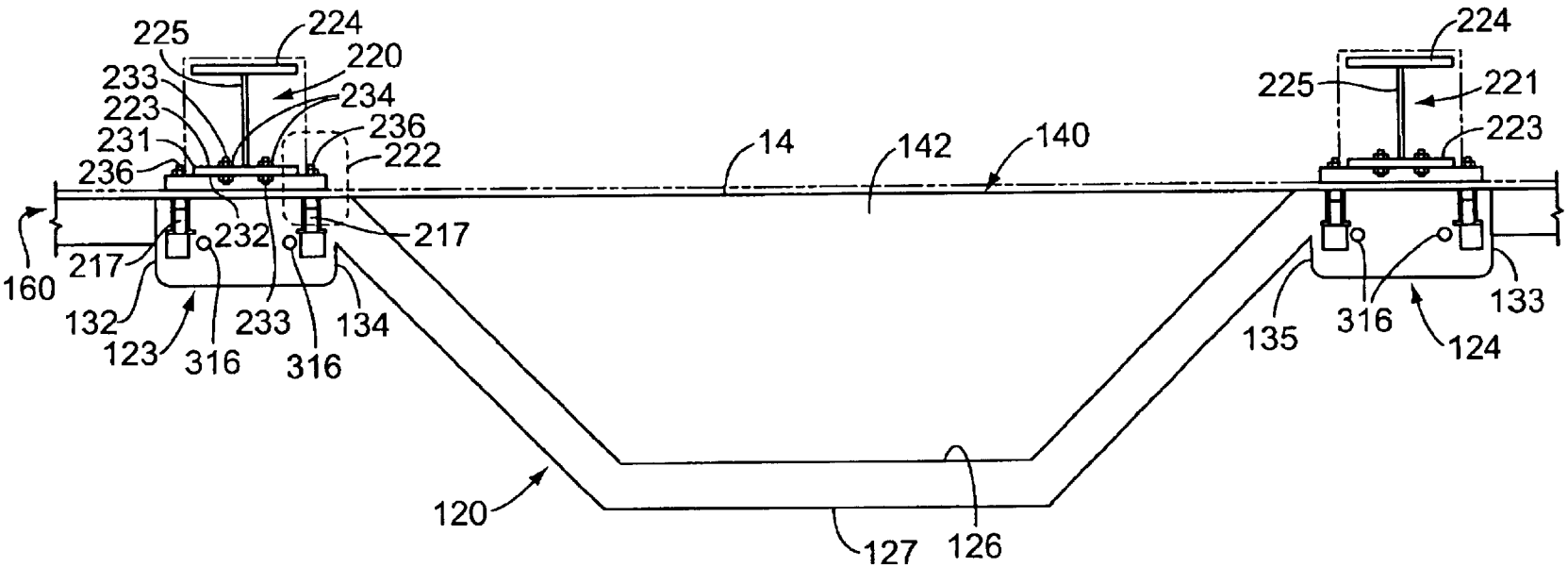

FIG. 20 is a plan view of an exterior wall panel coupled to two steel columns located toward the right side of and along the exterior wall shown in FIG. 2.

Figure 21:
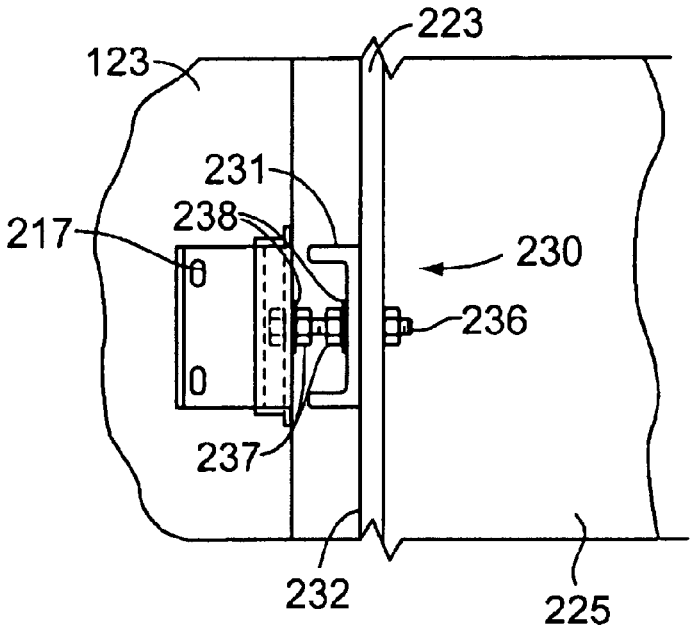

FIG. 21 is a detail drawing of the connection between one of the steel columns and the panel column.

Figure 22:
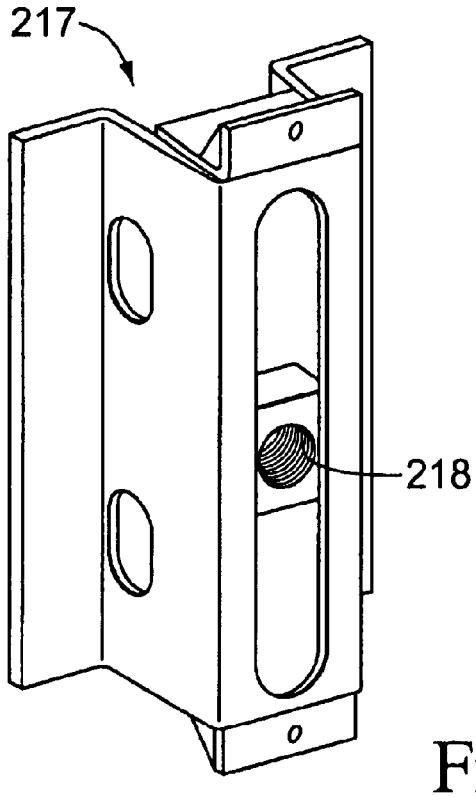

FIG. 22 is a perspective drawing of a Corewall® slotted insert used in couplings shown in FIGS. 19 and 21.

Figure 23:
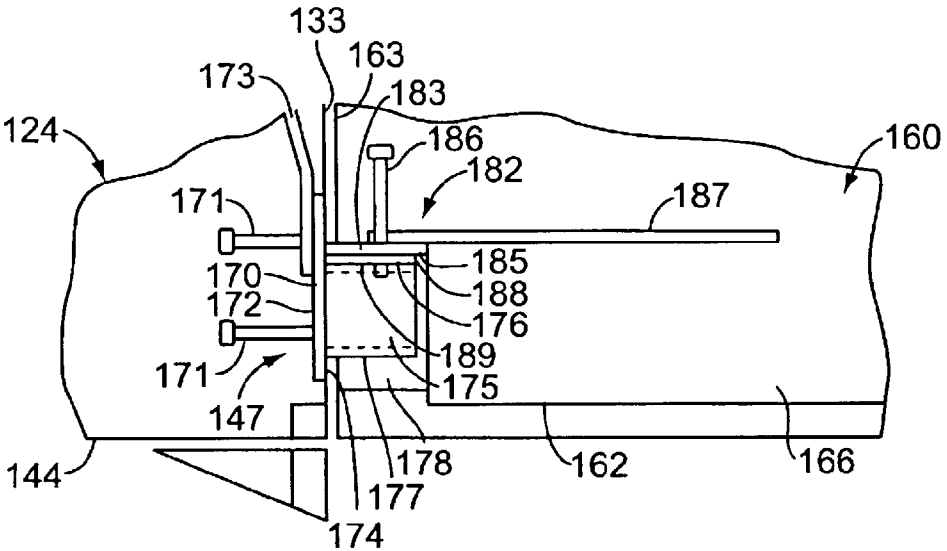

FIG. 23 is an elevation section view of an anchor and sleeve coupling between a bay panel column shown in FIG. 12 to a flat panel shown in FIG. 14.

Figure 24:
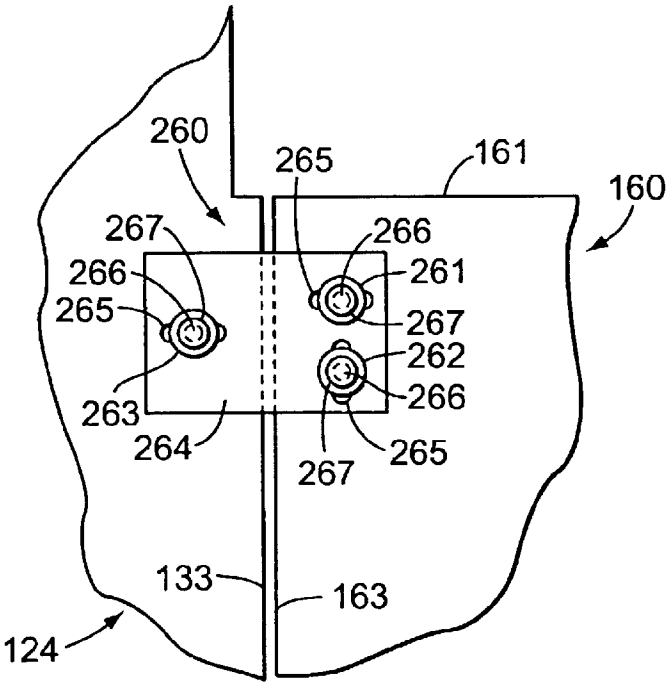

FIG. 24 is an elevation section view of a bracket coupling a bay panel column shown in FIG. 12 to a flat panel shown in FIG. 14.

The above Figures are better understood in connection with the following detailed description of a preferred embodiment of the invention.

DETAILED DESCRIPTION

The Shearwall Structure

Figure 1:
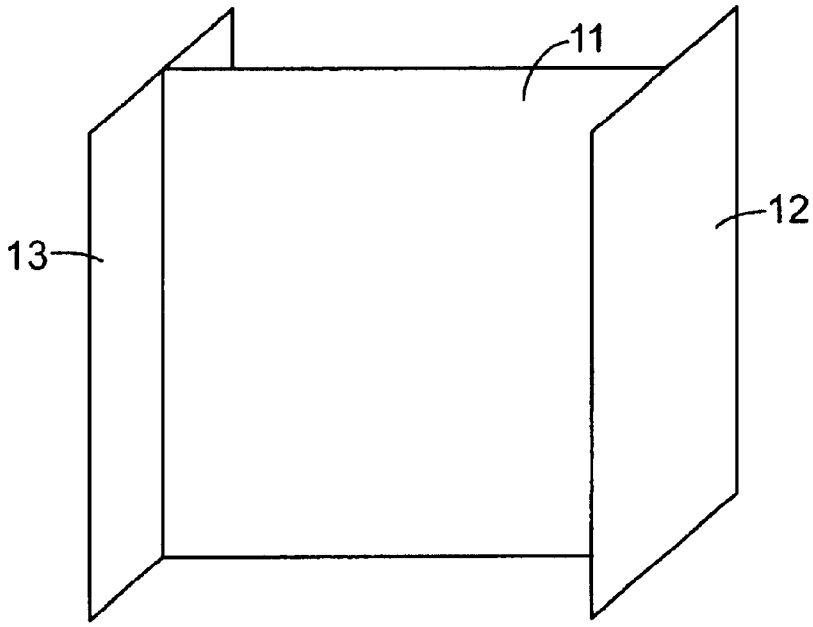
FIG. 1 is a perspective view of the reinforced concrete shearwalls of the structure without the other framework of the structure that the shearwalls support. Although not shown, these shearwalls will ordinarily have openings for doorways, windows and/or appliances.

FIG. 1 is a simplified perspective view of a preferred embodiment of reinforced concrete shearwalls 11, 12, and 13 providing the lateral and vertical support for the overall structured 10. Although not shown in FIG. 1, each of the shearwalls 11, 12 and 13 will ordinarily have openings for doorways, windows and/or appliances, as described in greater detail below. When viewed from above, the shearwalls 11, 12 and 13 in the preferred embodiment appear to form an "H" or an "I." As also explained below, beam and column framework made of steel, or other material with corresponding strength characteristics, and running along the plane of shearwalls 11, 12 or 13 may used in lieu of, or in addition to, the reinforced concrete to provide vertical and lateral integrity to the structure 10.

In a preferred embodiment, the wall 11 is approximately 10 inches thick while walls 12 and 13 are each approximately 12 inches thick. In other embodiments, these dimensions may vary depending on the vertical load requirements of the building and the materials comprising the wall. Even for a given fixed load, the thickness of a reinforced concrete wall may vary from wall to wall depending on the strength characteristics of the concrete being used as well as depend on the amount, type and thickness of the reinforcing bars, or rebars, being used as reinforcement in the concrete. Likewise, wall thickness requirements may differ at various heights of the building depending on the vertical load to be supported at any given height. Vertical load requirements for any building are inherently greater at lower levels of a structure than at higher levels. Determination of load support requirements is standard practice and well known to those skilled in the art. Similarly, design of reinforced concrete based on variables such as type of concrete, allowance for openings (for example, doors or windows), and type and amount of rebars to support those load requirements is well known. Indeed, publicly available computer software, such as ETABS-PLUS, incorporated by reference herein, is normally used today to make such determinations.

In the preferred embodiment of structure 10, wall 11 is approximately 90 feet long on its horizontal plane while each of walls 12 and 13 are approximately 40 feet long. Wall 11 is integral along one of its vertical ends with wall 12 and along wall 13 on the other of its vertical ends. The walls 12 and 13 are arranged perpendicular to a foundation. Wall 11 is substantially normal to walls 12 and 13. Combined, the walls 11, 12, and 13 are laterally and vertically self-supporting and provide lateral and vertical support for the remaining internal framework of the building (not shown in FIG. 1). The walls 11, 12, and 13 will also provide lateral support for the external walls of the building (also not shown i FIG. 1) and, depending on the exterior wall design, may also provide vertical support for one or more of the external walls.

In the preferred embodiment, structure 10 is seventeen stories, or approximately 153 feet, high. The ground floor and second level floor (not shown in FIG. 1) in the structure 10 are spaced approximately 10 feet 1 inch apart. Other adjacent floors above the ground floor are spaced approximately 9 feet 1 inch apart. These floors are connected to the shearwalls and act as stiffening elements providing diaphragm action to the shearwalls. It is evident to one skilled in the art that the design could be modified for shorter buildings so that height and vertical loading strength of the walls 11, 12 and 13 could be correspondingly reduced and floor-spacing modified. Similarly, it is evident to one skilled in the art that the design could be modified for taller buildings so that height and vertical loading strength of the walls 11, 12 and 13 could be correspondingly increased. Likewise, it is evident to one skilled in the art that the spacing between adjacent floors could be increased or decreased depending on aesthetic and design preferences. However, as a practical matter, it is not anticipated that the distance between adjacent, vertically-aligned floors exceed a distance of 25 feet.

In the preferred embodiment, the horizontal length of wall 11 is approximately 90 feet. The length to height ratio of the wall 11 in the preferred embodiment is therefore approximately 1.7:1. Depending on aesthetic design preferences and building code requirements, this ratio could be reduced to as low as 0.25:1 or increased to as much as 10:1. These ratios would hold true for any desired building height.

The horizontal length of wall 11 is approximately twice that of either wall 12 or 13. Depending on aesthetic design preferences and building code requirements, this approximate 2:1 ratio may be reduced to as low as 0.25:1 or increased to as much as 20:1. Again, these ratios would hold true for any desired building height. Likewise horizontal length of wall 12 may be as much as 20 times the length of wall 13.

In the preferred embodiment, side edges of wall 11 are proximately centered between the side edges of walls 12 and 13 to form an "H" or "I" configuration. However, depending on aesthetic design preferences and building code requirements, the wall 11 can be located anywhere along a line running perpendicular between walls 12 and 13. Indeed, walls 11, 12 and 13 can be aligned to form a "C" configuration and still maintain structural integrity. Likewise, one or more center walls similar to wall 11 may be included in the structure 10 while maintaining or even enhancing the structural integrity of the structure 10. For example, wall 11 and another similar wall can be aligned to form a hallway or corridor running between the walls 12 and 13.

As noted, in the preferred embodiment, the wall 11 runs perpendicular to walls 12 and 13. However, the joining angle formed by the intersection of walls 11 and 12 and of walls 11 and 13 can vary between 45 degrees and 135 degrees depending on aesthetic design preferences and building code requirements and still maintain structural integrity. Additionally, this angle variation between walls 11 and 12 and walls 11 and 13 may be independent of each other. Indeed, the included angle between walls 12 and 13 can vary between 45 degrees and 135 degrees again depending on aesthetic design preferences and building code requirements and still maintain structural integrity.

In the preferred embodiment, each of walls 11, 12, and 13 is comprised of prefabricated reinforced concrete panels stood vertically end-to-end on their edges and stacked on their horizontal edges. The panels are comprised of concrete reinforced with rebar. The panels are typically manufactured at a factory off-site and trucked to the building site.

The foundation 20 supporting the shearwalls 11, 12, and 13 and adjoining framework is designed and constructed to meet anticipated load and stress requirements using standard building techniques known to those skilled in the art. A top plan view of the foundation 20 of the preferred embodiment is shown in FIG. 2. Depending on the location of a building, building codes and costs of building materials, the foundation 20 of the building may be comprised of different materials known to those skilled in the art that meet the required strength and load requirements for a building. In the preferred embodiment, the foundation 20 is comprised primarily of reinforced concrete. As such, the foundation 20 contains rebars embedded in the concrete. The top 21 of reinforced concrete footings 23 of the foundation 20 are shown within the dashed borders of FIG. 2. The solid lines show a plan view of the first level 22 of framework of the building coupled to the foundation 20.

Figure 3:
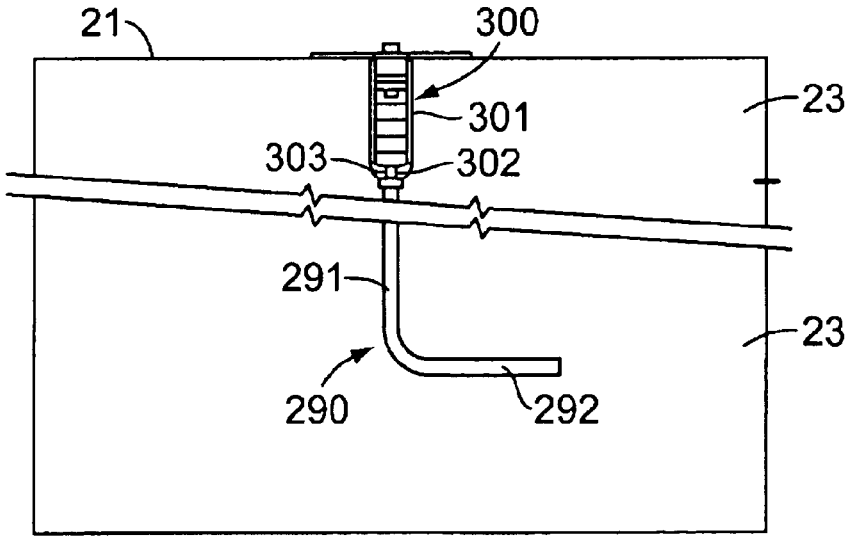
FIG. 3 is a section view of the foundation 20 illustrating the typical configuration of a coupler coupled to a rebar in the footing of the foundation 20 taken along lines 1—1, 2—2, or 3—3 of FIG. 2.

Couplers couple together the ends of different rebars. The series of small dots that appears within the borders of the framework represent the tops 299 of couplers. FIG. 3 is a section view of the foundation 20 illustrating the typical configuration of a coupler 300 coupled to a rebar 290 in the footing of the foundation 20 taken along lines 1—1, 2—2, or 3—3 of FIG. 2. The coupler 300 is coupled to rebar 290 whose upper portion 291 are aligned with the vertical plane of the building and are embedded in the foundation 20. The top 299 of coupler 300 is proximately flush with the top surface 21 of the foundation 20. The upper portion 291 of the rebar 290 is substantially perpendicular to the plane of the ground. The lower portion 292 of the rebar 290 is hooked in the footing 21 of the foundation 20 as shown in FIG. 3. The couplers used in the preferred embodiment are known as Lenton® couplers. The Lenton® coupler and the method of coupling the rebars that are used are more fully described in U.S. Pat. No. 5,366,672, incorporated herein by reference. The coupler is essentially a steel sleeve 301 with a threaded female component 302 at the lower end of the sleeve 301. The threaded component 302 of the sleeve 301 is coupled to the top 303 of a threaded component of the rebar 290.

The end portion of a rebar (not shown in FIG. 3) is placed in the coupler 300. In this instance, the rebar (not shown in FIG. 3) is one of a number of rebars that projects out from the bottom of a pre-cast wall panel such as the rebars 321, 319, or 321 shown in FIG. 4. As discussed more fully below, the rebars are embedded in the wall panel so as to align with and have their bottom portions fit within the couplers 300 once the panel is hoisted into place on the foundation 20. Grout is then injected into the couplers 300 and the voids surrounding the coupler. A layer of grout is also injected between the foundation 20 and the first level of panels thereby forming a monolithic wall with continuous rebar reinforcement between the foundation 20 and the wall of the building. This is but one method that may be used to couple or splice together the rebars that will form a continuous rebar reinforcement between the foundation 20 and a wall of the building. Rebars may also project out of the foundation 20 or panels while Lenton® couplers are embedded in and flush with the bottom of the panels. The panels are then placed on the foundation 20 or panels below so that the couplers 300 are placed over the ends of the rebar projecting out of the foundation 20 or panels below with grouting then taking place. Likewise, any other material and/or method of coupling or splicing rebars well known to those skilled in the art may be used in place of, or in addition to, the Lenton® couplers for coupling or splicing the rebars to form a monolithic reinforced concrete wall structure.

The load and strength requirements for the shearwalls are greater at or near the vertical edges of the end shearwalls 12 and 13 than at other points in the shearwalls. Accordingly, the couplers and rebars at these higher load locations are stronger than at other locations in the shearwalls 11, 12 and 13. For example, line 1—1 of FIG. 2 is taken near the vertical edge of the end shearwall 13. The rebar 290 along line 1—1 is #11 rebar, which is rebar that is approximately 1⅜ inches in diameter. The vertical length of the #11 rebar at this location is approximately 2 feet 7 11/16 inches from its top to its hooked portion with the top 1 11/16 inches of the #11 rebar being male-threaded. At the hook, the #11 rebar then extends 2 feet more in the horizontal direction. However, a rebar 290 in the shearwall 13 which is located closer to the center wall, such as along the line 2—2, or a rebar on an interior framework wall 14 or 15 that is not subjected to the stresses and loads of an end shearwall 12 or 13 such as along the line 3—3 of interior framework wall 14, is #8 rebar (which is rebar that is approximately 1 inch in diameter), has a vertical length of only approximately 2 feet 1⅜ inches from its top to the hook with only the top 1⅜ inches of the rebar 290 being threaded and the hooked portion in the horizontal direction only extending approximately 1 foot 4 inches. These anticipated loads and stresses and required rebar sizes and configurations are determined using standard formulae and calculations that are well known to those skilled in the art. As noted above, publicly available computer software is available to make such determinations. The configuration shown is but one of many that is known by those skilled in the art that could be used in the foundation 20.

Just as the rebar size is greater at or near vertical edges 16 and 17 of the end shearwall 12 and vertical edges 18 and 19 of the end shearwall 13 than at other points in the shearwalls 11, 12 or 13, so too is the size of the couplers greater at those points to accommodate the larger rebars. For example, the coupler 300 coupled to #11 rebar shown along line 1—1 is approximately 11⅝ inches long in the vertical direction, while the coupler 300 along line 2—2 and 3—3 is only 8⅝ inches long. As with the rebars, the size and strength of the coupler used at any given location depends on the anticipated loads and stresses on the foundation 20 or wall at any given point. Again, these anticipated loads and stresses are determined using standard formulae and calculations that are well known to those skilled in the art. Again, publicly available computer software is available to make such determinations. Similarly, other couplers and methods of coupling or splicing two pieces of rebar well known to those skilled in the art may be used to couple or splice the rebars together.

Figure 4:
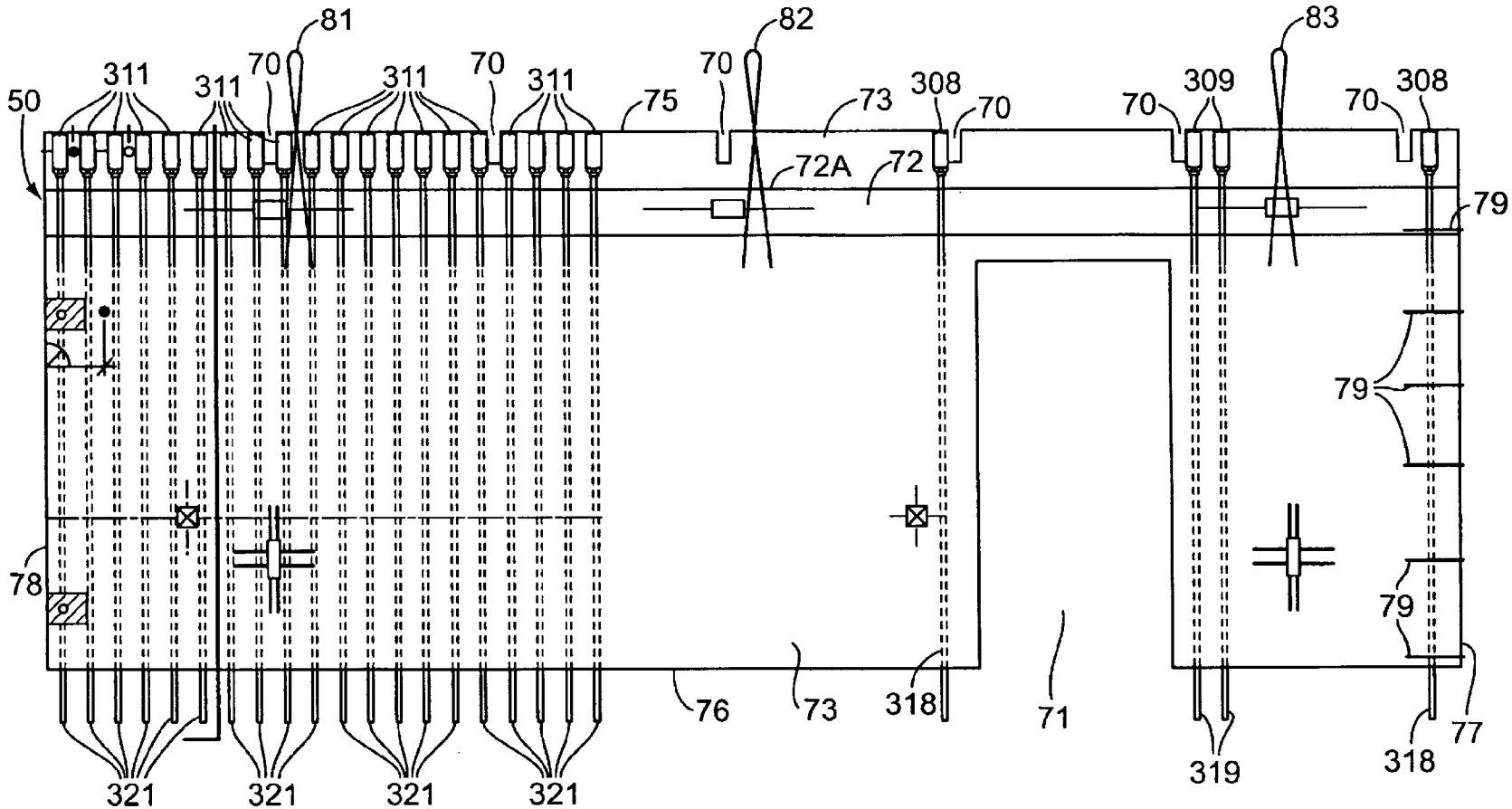
FIG. 4 is an elevation view of a typical shearwall panel 50 in the preferred embodiment showing the location of materials embedded in the shearwall 13.
Figure 5:
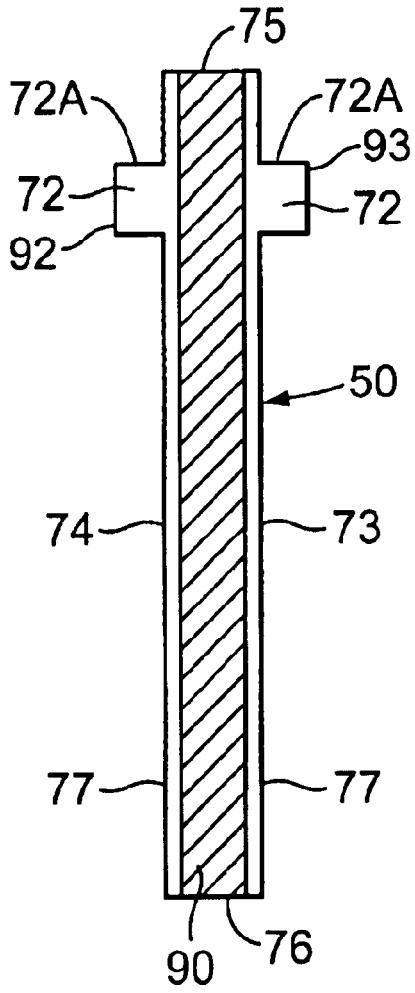
FIG. 5 is a section view of panel 50 along line 6—6 shown in FIG. 4.
Figure 6:
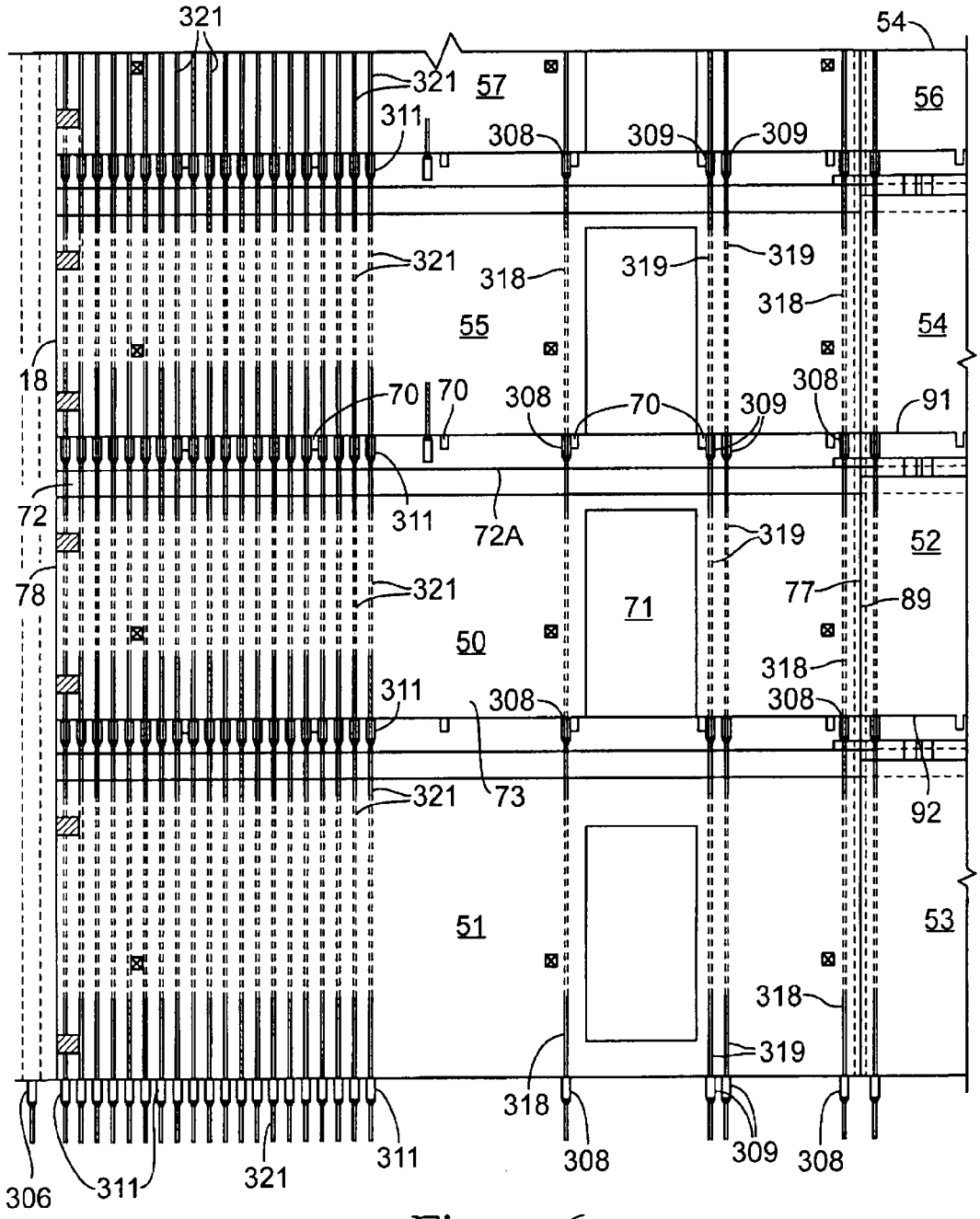
FIG. 6 is an elevation view of panel 50 shown in FIG. 4 along with other panels located in the shearwall 13.

FIG. 4 is an elevation view of a typical shearwall panel 50 in the preferred embodiment showing the location of materials embedded in the shearwall 13 along line 14—14 of FIG. 2. FIG. 5 is a section view of panel 50 taken along line 6—6. FIG. 6 is an elevation view of panel 50 along with other panels 51, 52, 53, 54, 55, 56 and 57 located in the end shearwall 13. As shown in FIG. 6, panel 50 is located on the second level of panels of the wall 13. However, its configuration and method of coupling to the wall is representative of other panels placed on the shearwalls 11, 12 and 13 as well as directly on the foundation 20.

Except for certain pieces of rebar that highlight features of the invention, the remaining rebars and steel mesh that run throughout the panel are not shown. The various types and configurations of reinforcing material that meet the given the load and strength requirements for the panels are well known to those skilled in the art. Also not shown is header assembly embedded in the panel 50 above the void 71 shown in the panel 50 for, in this embodiment, a doorway. Again, header assemblies and their configurations are known and used throughout the industry and are well known to those skilled in the art. The panel 50 is approximately 24 feet, 10¾ inches in length, 9 feet in height, and 1 foot in width, except at its haunch 72 where it is approximately 2 feet wide. It weighs approximately 32,000 pounds. The compression strength of the concrete in the panel 50 shown is a minimum of 6,000 p.s.i. The compression strength requirement of the concrete can vary depending on the load requirements and the amount and configuration of the rebars within the panels. Again, the interplay of these variables is well-known to those skilled in the art.

As best seen in FIG. 5, a haunch 72 begins on panel 50 approximately 1 foot down from the top of panel 50. The haunch 72 extends out approximately 12 inches from the center line of the panel 50, and down for a length 8 inches on each face 73 and 74 of the panel 50. At that point both faces 73 and 74 at the haunch 72 slope back in a straight line approximately 1 inch down and 6 inches over toward the centerline of panel 50. As seen in FIG. 4, the haunch 72 extends the entire length of the panel 50.

In the embodiment shown, a void 71 for a doorway begins approximately 5 feet, 2¼ inches to the left of the bottom right-hand corner of the panel 50 and extends approximately 6 feet, 10½ inches up, 3 feet 4½ inches over to the left, and back down to the bottom of the panel 50. It is well known to those skilled in the art that, depending on the desired features of a building, voids or openings of various sizes for various purposes such as windows, elevator doors or stairwells may be configured into the panels, with corresponding changes being made in the amount and location of rebars and type of concrete being used in the panel.

The panel 50 in the embodiment shown has twenty-four couplers attached to rebars centered approximately midway between the faces 72 and 73 of the panel 50 and running from the top edge of the panel 50 and extending down through the panel 50 with the rebars projecting varying distances beyond the bottom edge of the panel 50. In the preferred embodiment, Lenton® couplers are used in conjunction with rebars threaded in their top portion. Again, however, any method of coupling or splicing the rebars may be used. In this embodiment of the invention, the concentric centers of twenty #11 couplers 311 with #11 rebars 321 are spaced 6 inches apart from each other along the length of the panel 50 beginning 3 inches from left side edge 78 of the panel 50. Each of the twenty couplers 311 is approximately 10 13/16 inches long and coupled to a piece of #11 rebar. The top of each coupler 311 is flush with the top edge 75 of the panel 50. The #11 rebar to which it is coupled runs down through the panel 50 and extends approximately 10¼ inches beyond the bottom edge 76 of panel 50. There is also a #8 coupler 308 coupled to a #8 rebar 318 whose concentric center is located 7 inches to the right of the void 71 for the doorway. This coupler 308 is approximately 8⅝ inches long. The piece of rebar 318 coupled to the coupler 308 is #8 rebar and runs down through, and extends approximately 7½ inches beyond the bottom edge 76 of the panel 50. There are also two #9 couplers 309 coupled to #9 rebars 319 whose concentric centers are located approximately 5 inches and 12 inches, respectively, to the right of the doorway void of panel 50. Each of these two couplers 309 is approximately 9¾ inches long. The piece of rebar 319 coupled to each coupler 309 is #9 rebar, which is rebar that is about 1⅛ inches in diameter, and runs down through, and extends about 8½ inches beyond the bottom edge 76 of the panel 50. Finally, there is a #8 coupler 308 coupled to a #8 rebar 318 whose concentric center is located 6 inches from the right side edge 77 of the panel 50. This coupler 308 is approximately 8⅝ inches long. The piece of rebar 318 coupled to the coupler 308 is #8 rebar and runs down through, and extends 7½ inches beyond the bottom edge 76 of the panel 50. An elevation view of panel 50 is shown with adjoining panels in FIG. 6 that form part of the shearwall 13. As shown in FIG. 6, the rebars 318, 319, and 321 coupled to couplers 308, 309 and 311 in panel 50 are arranged to fit into other couplers 308, 309, and 311 of the panel already in place on the foundation 20 when panel 50 is hoisted into place on the shearwall 13. It should be clear to one of ordinary skill in the art that all of the dimensions provided are approximate, based on a specific preferred embodiment, and may be altered depending on need.

In the embodiment shown, three double liftloops 81, 82 and 83 located approximately 4 feet 6 inches, 12 feet 7 inches, and 21 feet 8½ inches, respectively, from the left edge 78 of the panel 50 are embedded in the top portion of panel 50. The liftloops 81, 82 and 83 are used in this embodiment by cranes to attach onto and hoist the panel 50 into place on the shearwall 13. Once the panel 50 is in place on the shearwall 13, the top portion of each liftloop 81, 82 and 83 is severed from the panel 50 along the top edge 75 of the panel 50. The liftloops 81, 82 and 83 are not necessarily required. Other methods known to those skilled in the art of attaching onto a panel and/or lifting a panel may be used to put a panel in place on the shearwalls 11, 12 or 13.

Before the panel 50 is hoisted into place, a shim, not shown, is placed near each end of the top edge of the panel 51 already in place on the shearwall 13. The panel 50 is then hoisted onto the shims with the rebars 318, 319, and 321 extending from the bottom of panel 50 being inserted into the corresponding couplers 308, 309, and 311 of the panel 51 below. The voids in and surrounding the couplers 308, 309, and 311 and rebars 318, 319, and 321 are then grouted. A layer of grout is also injected between the panel 50 and the lower panel 51. Thus, the monolithic shearwall 13 with continuous rebar reinforcement from the foundation 20 up through the lower panel is extended up through panel 50.

The required compression strength of the concrete in the shearwalls 11, 12 and 13 of the preferred embodiment is a minimum of 6,000 p.s.i. However, it is evident that the vertical load and stresses on the shearwalls 11, 12 and 13 is less at higher elevations on the shearwalls than at lower elevations. Accordingly, less reinforcement is necessary in the panels located higher in the shearwalls 11, 12 and 113 than those panels located lower in the shearwalls 11, 12 and 13. For example, where the three panels on the first three floors located along the side edge 18 of the end shearwall 13 use twenty #11 rebars 321 spaced approximately 6 inches apart, the corresponding panel on the fourth floor uses only sixteen #10 rebars, which are rebars that are each about 1¼ inches in diameter, spaced 6 inches apart. On the tenth floor, only six #10 rebars are necessary to maintain the structural integrity of the building. On the seventeenth floor, only one #8 rebar is necessary to maintain the structural integrity of the building.

Figure 7:
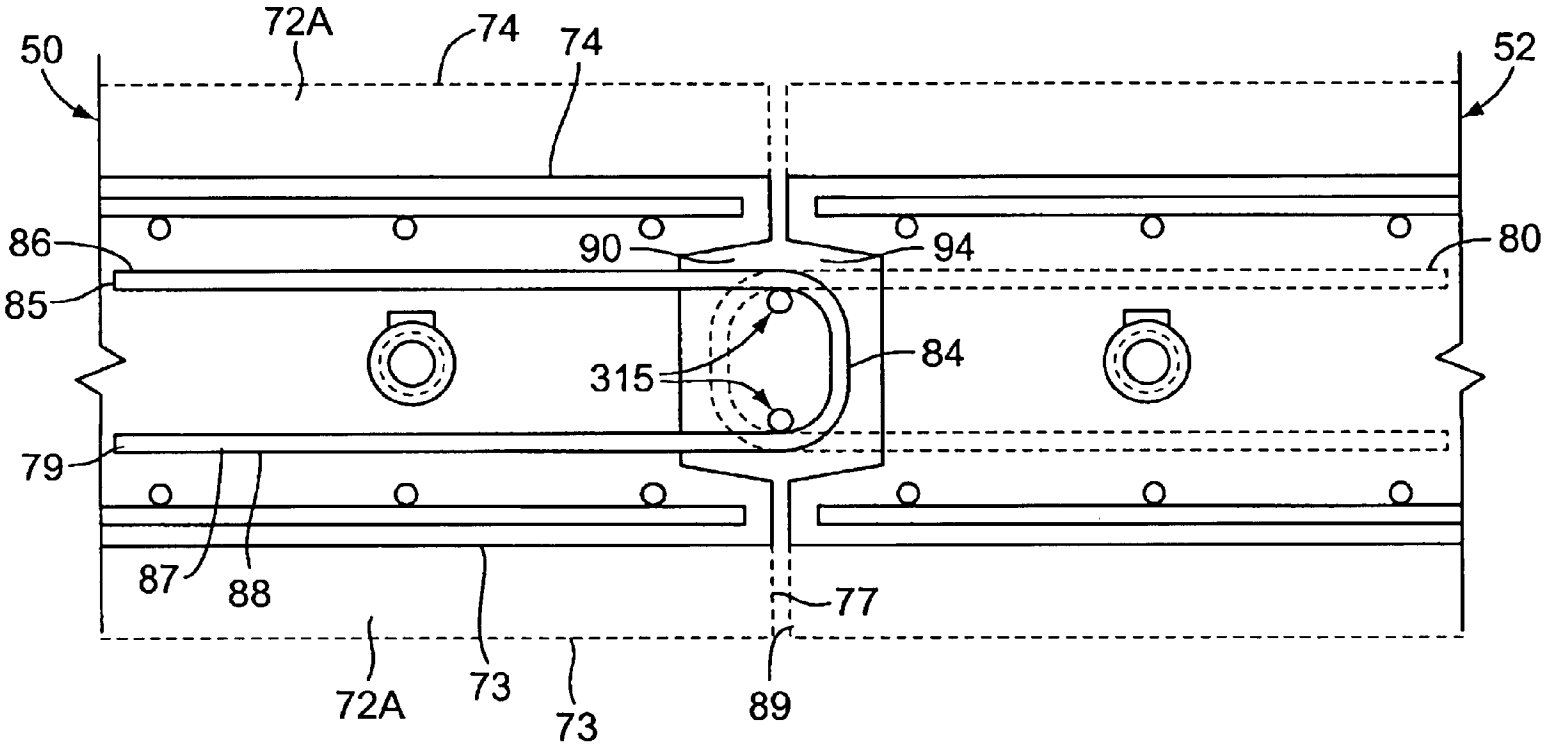
FIG. 7 is a plan section view of the connection of panel 50 and the panel laterally adjacent panel 50.

Once panel 50 and its laterally adjacent panel 52 have been vertically aligned and coupled to the panels 51 and 53 immediately below, the panel 50 and its laterally adjacent panel 52 are coupled. The following procedure that is described in detail for coupling these two laterally adjacent panels 50 and 52 is the same as that followed in coupling other laterally adjacent panels, including the two laterally adjacent panels and 53 located immediately below panel 50 and its laterally adjacent panel 52. Six pieces of #5 hairpin rebar 79, each of which is about ⅝ inches in diameter, are shown in FIG. 4. Each hairpin rebar 79 projects approximately 2¾ inches out from the right-most vertical plane of the right edge of panel 50 and extends approximately 21¼ inches perpendicularly in from that right side edge 77 of the panel 50. Beginning approximately 3 inches from the bottom of panel 50, the hairpin rebars 79 are spaced approximately 18 inches apart. The configuration of these six pieces of rebar 79 within the panel 50 is best seen in FIG. 7, a plan view along line 7—7 of FIG. 6 of the connection of panel 50 and its laterally adjacent panel 52. The laterally adjacent panel 52 likewise has six pieces of #5 hairpin rebar staggered with the #5 hairpin rebars 79 of panel 50. Each of the hairpin rebars 79 is 2 feet long from the top 84 of the hook of the hairpin to the plane perpendicular to the end of each prong of the hairpin rebar 79 and is 6 inches wide from the outside edge 86 of one prong 85 of the hairpin rebar 79 to the outside edge 88 of the second prong 87. Each hairpin rebar 80 of the laterally adjacent panel 52 projects approximately 2¾ inches out from the left-most vertical plane of the left edge 89 of the laterally adjacent panel 52 and extends approximately 21¼ inches perpendicularly into the laterally adjacent panel 52 from that left side edge 89 of the vertically adjacent panel 52. Beginning 5 inches from the bottom of the laterally adjacent panel 52, the hairpin rebars 80 are spaced 18 inches apart.

Both the right side edge 77 of panel 50 and the left side edge 89 of the laterally adjacent panel 52 have a void, or keyway 90, which resets in from what would otherwise be the plane of the vertical edges 77 and 89. The keyway 90 is depicted by the hatched area in FIG. 5. Each keyway 90 runs from the top edge 75 of panel 50 to the bottom edge 76 of panel 50 and from the top edge 91 of panel 52 to the bottom edge 92 of panel 52. The keyway 90 begins on the right side edge 77 of panel 50 approximately 2 inches from the first face 73 of the panel 50 (except at the haunch 72, where it begins approximately 8 inches from the vertical edge 93 of the haunch 72), slopes in a straight line to a point approximately 3 inches from the right edge and 2½ inches in from the first face 73. From that point, the keyway 90 continues approximately 7 inches along a plane parallel to the plane of what would otherwise be the plane of the vertical edge 77. Finally, the keyway 90 slopes back out to what would otherwise be the plane of the vertical edge 77 to a point approximately 2 inches from the second face 74 of the panel 50 (except at the haunch 72, where it ends approximately 8 inches from the vertical edge 92 of the haunch 72), such that the keyway 90 is centered between the two faces 73 and 74 of the panel 50. The keyway 94 of laterally adjacent panel 52 mirrors the keyway 90 of panel 50.

When coupled to the panels 51 and 53 below, the furthest right side edge 77 of panel 50 and the furthest left side edge 89 of the laterally adjacent panel 52 are approximately ½ inch apart. Two #5 rebars 315 running from the top of the panel to the bottom of the panel 50 are placed in the keyways 90 and 94 between the two panels 50 and 52 such that each of the #5 rebars 315 is proximate to and is looped by each of the hairpin rebars 79 and 80 in each of the two panels 50 and 52, respectively. The space between the two panels 50 and 52 is then filled with grout so that the adjacent panels 50 and 52 form part of the monolithic reinforced concrete shearwall 13.

This same procedure is also followed to couple the end of the center shearwall 11 to end shearwalls 12 and 13. FIG. 8 shows a top plan section view of the arrangement of end shearwall 13 and center shearwall 11 taken along line 8—8 of FIG. 2. A keyway 95 approximately the same shape and dimension as keyway 90 on the side edge 77 of panel 50 is located in the side edge 24 of center shearwall 11. A corresponding keyway 96 approximately the same shape and dimension as keyway is located in the face 25 of end shearwall 13 directly opposing keyway 95. #5 hairpin rebars are positioned and spaced in center shearwall 11 along the entirety of side edge 24 in approximately the same manner as rebars 85 are positioned and spaced along side edge 77. The FIG. 8A shows a top plan section view of the arrangement of #4 hairpin rebars 98 positioned and spaced along the face 25 of end shearwall 13 in approximately the same manner as rebars 80 are positioned and spaced along side edge 89. The center portion of each rebar 98 is hooked and extends from the edge 97 of keyway 96 that in the preferred embodiment is proximately parallel to the face 25 of end shearwall 13. The prongs of rebar 98 extend normal to the face 25 into the end shearwall 13 from the edge 97 approximately 7¼ inches and then each prong of rebar 98 bends at an approximately 90 degree angle in direction away from the opposing prong and extends approximately 2 feet along a plane parallel to the face 25 of end shearwall 13. As done in coupling laterally adjacent panels of the shearwalls 11, 12 and 13, #5 rebar is placed vertically into the space formed by keyways 95 and 96. That space is filled with grout to form a monolithic reinforced concrete connection between the center shearwall 11 and the end shearwall 13. As recognized and known by those skilled in the art, this is but one of many ways two shearwalls may be coupled together.

In the preferred embodiment of the invention, the shearwalls 11, 12 and 13 are formed entirely of panels that have been grouted together as described above to form a monolithic reinforced concrete structure. For purposes of demonstrating the variety of forms the invention may take, the end shearwall 13 in the embodiment shown includes a reinforced concrete column 58 approximately 18 feet 9¼ inches high on the foundation 20 in place of two vertically stacked panels. FIG. 9 is an elevation view of a portion of the end shearwall 13 taken along line 9—9 of FIG. 2. FIG. 9 shows the column 58 and the panels 59, 60, 61 and 62 next to or near the column 19. One side 101 of the column 58 is located where the side edge 19 of the end shearwall 13 would otherwise be located. Although the column 58 could take on any number of configurations known to those skilled in the art, the column 58 used in this embodiment is approximately 44 inches by 44 inches with a 6-inch by 6-inch square cut out of each corner of the column 58. The side edge 102 of the nearest shearwall panels 59 and 60 to the column 58 is approximately 9 feet 5 inches away from the column 58 thereby forming an arcade two stories high. Being on what would otherwise be an edge of the end shearwall 13, the column 58 is heavily reinforced with ten #11 rebars 321 coupled to corresponding couplers 311 and rebars 321 in the foundation 20. FIG. 10 is a plan view of the column 58 and the ten couplers 311 in the foundation 20 under the column 58 taken along line 10—10 in FIG. 9. As shown in FIG. 10, the concentric centers of two of the #11 rebars 321 in the column 58 are spaced approximately 24 inches apart on what would otherwise be the centerline of the end shearwall 13. The concentric centers of four more of the ten #11 rebars 321 are located approximately 8 inches on a line perpendicular to the centerline of the end shearwall 13 on each side of the concentric center of the two rebars 321 along the centerline thereby forming two rows of three rebars 321 perpendicular to the centerline. Between each of the two rows of rebars 321 are the four remaining #11 rebars 321. Their concentric centers are located approximately 8 inches off the center line and 8 inches from the concentric center of the rebar 321 at the end of each row on a line parallel to the centerline of the shearwall 13, in effect forming two rows of four #11 rebars 321 that are 8 inches off the centerline of the shearwall 13.

As seen in FIG. 9, each #11 rebar 321 extends vertically beyond the bottom end of the column 58 to fit into a corresponding coupler 311 in the foundation 20. The two #11 rebars 321 along the centerline of the shearwall 13 extend vertically up through the column 58 and each is coupled to a coupler 311 whose top is flush with the top 103 of the column 58. The #11 rebars 321 in the two rows of four rebars 321 located approximately 8 inches off the center line extend vertically up 16 feet 9 inches from the bottom of the column 58. Three additional couplers 311 are evenly spaced along the centerline of the shearwall 13 between the two couplers 311 that are coupled to the two #11 rebars 321 extending from the bottom of the column 58 along the centerline of the shearwall 13. A #11 rebar approximately 54 inches long and extending vertically down into the column 58 is coupled to the bottom of each of the three additional couplers 311 spaced along the centerline of the shearwall 13 so as to lap the #11 rebars 321 extending up from the base of column 58.

The end shearwall 13 above the arcade is assembled with panels in the same way as that discussed above for other portions of the end shearwall 13.

The floors between the walls may be constructed by any using any methods and materials that are well known to those skilled in the art. In the preferred embodiment, the floors are comprised of hollow reinforced concrete planks hung on the haunches of and coupled to wall panels. The coupling between panel 50 and the floor panels (not shown) hung on the haunch 72 of panel 50 is representative of the method in which other floor planks are coupled to other panels in the building. The panel 50 contains six smaller voids 70 extending from one face 73 of the panel to the second face 74 of panel 50 and spaced across the top of the panel 50 as shown in FIG. 4. Each void 70 is approximately 3 inches wide and 5 inches deep. Once panel 50 is erected on the shearwall 13, bearing strips (not shown) are placed on the top 72A of the haunch 72. The floor planks are then hung on both sides of panel 50 from the haunch 72 of panel 50 to the haunch of another wall panel already constructed into the framework of the building, or to a horizontal beam or other support already constructed into the framework of the building. In panel 50, the distance from the top 72A of the haunch 72 to the top 75 of the panel 50 is approximately 1 foot. The thickness of the floor planks (not shown) hung from the top 72A of the haunch 72 of the panel 50 is also about 1 foot. There is a gap of about 1 inch between the end of the floor planks and the faces 73 and 74 of panel 50. There is groove approximately 3 inches wide, 5 inches deep, and 18 inches long in each of the floor planks on either side of the panel 50 arranged to align with one of the 3 inch by 5 inch voids 70 in panel 50. A 4-foot piece of #4 rebar (not shown), which is rebar that is about ½ inch in diameter, is then placed in the panel 50 void and the grooves in the two panels either side of the void. The 1-inch space between the opposing faces 73 and 74 of panel 50 and the floor planks, as well as the voids 70 in the panel 50 and the grooves of the two planks are then grouted with concrete thereby forming a monolithic concrete structure between the panel 50 and the floor planks, with the #4 rebar acting as a dowel to help hold the floor planks in place. The connected floor components then act as stiffening elements providing diaphragm action to the shearwalls.

The process described above will be repeated level by level, or floor by floor, until the desired height of the shearwalls 11, 12 and 13 and the adjoining framework is achieved. A roof structure, not shown, is then built onto to the structure, including the shearwalls 11, 12 and 13, thereby completing the structure.

The shearwalls 11, 12 and 13 in the preferred embodiment are constructed of reinforced concrete panels which, when coupled, form a monolithic reinforced concrete structure 10 with coupled or spliced rebars running continuously from the foundation 20 of the structure to proximate the top of the structure 10. In other embodiments of the invention, steel reinforcement may be configured for the shearwalls 11, 12 and 13 and the concrete cast on-site using methods and materials that are well known to those skilled in the art. A combination of casting concrete on-site for building a portion of the shearwalls 11, 12 and 13 and using pre-cast reinforced concrete panels may also be used with methods and materials that are well known to those skilled in the art.

Similarly, the shearwalls 11, 12 and 13 may be comprised of materials other than, or in combination with, reinforced concrete. For example, a steel column may replace the reinforced concrete column in the embodiment described in detail above. In other embodiments, the entire structural integrity of the "H," "I" or "C" shearwalls may provided by steel beams and columns.

The Reinforced Concrete Exterior Wall

Three of the four exterior walls in the embodiment shown are constructed and coupled to the internal end shearwalls 12 and 13 using standard designs, building techniques, and materials known to those skilled in the art. Each of these three exterior walls is either comprised primarily of a materials other than reinforced concrete or is at least partially dependent on the adjoining structure for vertical support. One exterior wall, however, is comprised of reinforced concrete and is vertically self-supporting along a vertical support plane. That exterior wall may be comprised completely of reinforced concrete without openings for windows, doors or appliances. However, a more likely embodiment of the reinforced concrete wall will contain voids or openings for windows, doors and/or appliances. As long as alignment along the vertical support plane is maintained, alternative embodiments of the exterior wall may also include portions that project out or recess in from the support plane of the exterior wall.

FIG. 11 is an elevation view of a portion of the reinforced concrete exterior wall 30 of the preferred embodiment taken along line 11—11 of FIG. 2. The exterior wall 30 of this embodiment has both voids for windows and appliances and portions that project out from the vertical support plane of the exterior wall. The projections out from the vertical support plane are better seen along the bottom of FIG. 2. The top 21 reinforced concrete footings 23 of the foundation 20 are shown within the dashed borders of FIG. 2. The solid lines show a plan view of the first level 22 of framework of the building coupled to the foundation 20. The series of small dots in FIG. 2 that appear within the borders of the two solid lines representing the exterior wall depict the tops of couplers 299 coupled to rebars 290 whose upper portions are aligned with the vertical plane of the exterior wall 30 and are embedded in the foundation 20 just as the couplers and rebars are aligned in the shearwalls 11, 12 and 13 and embedded in the foundation 20 as discussed above in connection with FIG. 3. As in foundation 20 underlying the shearwalls 11, 12 and 13, the tops of the couplers 299 are proximately flush with the top surface 21 of the foundation 20.

In the embodiment shown, the vertical load of the exterior wall is borne by reinforced concrete surrounding twelve pairs of rebars running from the foundation 20 to proximate the top of the exterior wall 30 wherein the vertically aligned rebars are coupled together with Lenton® couplers as in the shearwalls 11, and 13. Again, as with the rebars vertically aligned end-to-end in the shearwalls, the rebars may be coupled or spliced together using any variety of materials and/or methods known to those skilled in the art.

Each pair of rebars and couplers is located in a reinforced concrete section of the exterior wall 30 that is approximately 1 foot thick from the outside face 31 to the inside face 32 of the exterior wall 30 and is 2 feet long along the vertical plane of the building. Like the coupled rebars discussed above in connection with forming shearwalls 11, 12, or 13, each 1-foot by 2-foot section of reinforced concrete runs from the foundation 20 to proximate the top of the exterior wall 30, effectively forming twelve monolithic reinforced concrete columns 33 from the foundation 20 to proximate the top of the exterior wall 30. From a plan view of each column 33 in FIG. 2, the concentric center of each rebar and coupler is located 6 inches horizontally and 6 inches vertically from the two corners along either 2-foot edge 34 and 35 of the column 33. The columns 33 are connected by approximately 6-inch thick reinforced concrete 36 to form the exterior wall 30. The borders surrounding the dotted lines in FIG. 11 forming x's, or crosses, represent voids 37 and 38 in the exterior wall 30 for window frames. The borders surrounding the solid lines in FIG. 11 forming x's, or crosses, represent voids 39 in the wall for appliances. Thus, as seen in FIG. 11, this 6-inch thick reinforced concrete only spans portions of the vertical edges of the columns 33, leaving voids 37, 38 and 39 for window frames, door frames, and appliances. In other embodiments of the invention, there may be no such voids.

As with the shearwalls 11, 12 and 13, the dimensions and configurations of the reinforced concrete and the rebar in the concrete of the exterior wall 30 may vary in other embodiments of the invention depending on the vertical load requirements of the exterior wall 30. Even for a given fixed load, the thickness of a reinforced concrete wall may vary from wall to wall depending on the strength characteristics of the concrete being used as well as depending on the amount, type and thickness of the reinforcing bars, or rebars, being used as reinforcement in the concrete. Likewise, exterior wall thickness requirements may differ at various heights of the building depending on the vertical load to be supported at any given height. Vertical load requirements for any building are inherently greater at lower levels of a structure than at higher levels. Determination of load support requirements is standard practice and well known to those skilled in the art. Similarly, design of reinforced concrete based on variables such as type of concrete, allowance for openings (for example, doors or windows), and type and amount of rebar to support those load requirements is well known. Indeed, publicly available computer software, such as ETABS-PLUS, incorporated by reference herein, is normally used today to make such determinations.

Just as an option for building the shearwalls 11, 12 and 13 included configuring the rebar and casting the concrete on-site, so too may the exterior wall 30 be constructed. Likewise, as with the shearwalls 11, 12 and 13, a combination of casting concrete on-site for building a portion of the exterior wall 30 and using pre-cast reinforced concrete panels may also be used. However, as with the shearwalls, pre-cast reinforced concrete panels are used in the preferred embodiment of the invention to construct the exterior wall 30 to obtain the same economies and efficiencies as those described for use of panels in the shearwalls 11, 12 and 13.

In the embodiment shown, the exterior wall 30 is constructed basically of two different pre-cast reinforced concrete panels, a bay panel 120 and a flat panel 160. A plan view of the bay panel 120 is shown in FIG. 12 and an elevation view in FIG. 13. The three large crosses in dotted lines in FIG. 12 indicate an opening 121 for three windows and correspond to the crosses 38 in FIG. 11. The small cross in dotted lines in FIG. 12 indicates an opening 122 for a heating/cooling unit and corresponds to the cross 39 beneath the crosses 38 in FIG. 11. The bay panel 120 is approximately 15 feet long along its vertical support plane and weighs approximately 6,500 pounds. Bay panel 120 contains a first column 123 and a second column 124 that are each a portion of two of the twelve columns 31. Columns 123 and 124 are joined by an approximately 6-inch thick span 125 of reinforced concrete. The vertical support plane is formed along a line joining the twelve pairs of rebar discussed above. The first column 123 and second column 124 of bay panel 120 are each approximately 9 feet ½ inch high. The 6-inch thick span 125 connecting the columns is approximately 4 feet 5 inches high. The side 126 of the 6-inch thick span 125 facing the inside of the building is aligned with the side 128 of the first column 123 also facing the inside of the building. The 6-inch thick span 125 projects out from the building at an approximately 45 degree angle from the column 123 to a point where the side 127 of the 6-inch thick span 125 facing the outside of the building is a distance of approximately 2 feet 6 inches from the plane formed by the outside faces 130 and 131 of the first and second columns 123 and 124, respectively. The 6-inch thick span 125 then proceeds on a plane parallel to the plane formed by the outside faces 130 and 131 of the columns 123 and 124 to a point where the 6-inch thick span 125 takes a 45 degree turn back toward the second column 124 such that the inside face 126 of the 6-inch thick span 125 is aligned with the side 129 of the second column 124 facing the inside of the building.

An opening 122 approximately 3 feet wide and 16 inches high is vertically centered in the portion of the 6-inch thick span 125 on the plane parallel to the plane formed by the outside faces 130 and 131 of the columns 123 and 124 of the bay panel 120. The top edge 139 of the opening 122 is located approximately 8 inches down from the top edge 138 of the 6-inch thick span 125. This opening 122 is used to accommodate a heating and/or cooling unit.

Also cast into the bay panel 120 is a non-load bearing floor 140 filling the void otherwise left between the plane formed by the inside faces 128 and 129 of the columns 123 and 124 and the inside face 126 of the 6-inch thick span 125. This non-load bearing floor 140 is about 5¼ inches thick. The bottom edge (not shown) of this non-load bearing floor 140 is located approximately 19 inches from the bottom edge of the 6-inch thick span 125 on a plane perpendicular to the vertical plane of the columns 123 and 124. The bay panel 120 is designed and constructed in the exterior wall 30 so that the top edge 142 of the non-load bearing floor 140 of the bay panel 120 will be flush with the top surface of the floor planks in the interior of the building.

A plan view of a flat panel 160 is shown in FIG. 14 and an elevation view in FIG. 15. The flat panel 160 is approximately 10 feet 5 inches long, 4 feet 5 inches high, 6 inches thick, and weighs approximately 3,500 pounds. The flat panel 160 has an opening 166 indicated by the dashed cross in FIG. 15. The opening 166 corresponds to the opening 39 under the openings 37 in FIG. 11. The opening 166 is approximately 3 feet wide and 16 inches high to accommodate a heating and/or cooling unit. The top edge 167 of the opening 166 is located approximately 8 inches down from the top edge 161 of the flat panel 160. Vertical edge 168 of the opening 166 is located approximately 3 feet 8½ inches from the vertical edge 163 of the flat panel 160 while vertical edge 169 of the opening 166 is located a similar distance from the vertical edge 164 of flat panel 160.

Except for certain pieces of rebar that highlight features that they bring to the invention, the remaining rebars and steel mesh that run throughout the exterior bay panels 120 and flat panels 160 are not shown in FIGS. 12 through 17 and 20. The various types and configurations of reinforcing material that meet the given load and strength requirements for the bay panels 120 and the flat panels 160 are well known to those skilled in the art. The compressive strength of the concrete in the bay panel 120 and the flat panel 160 per design criteria is a minimum of 5,000 p.s.i. However the actual controlled cylinder breaks are between 5,900 and 6,300 p.s.i. The comprehensive strength requirement of the concrete will vary depending on the load requirements and the amount and configuration of the rebar within the panel. Again, the interplay of these variables is well-known to those skilled in the art.

Vertically aligned exterior bay panels 120 containing a pair of the columns 123 and 124 in the preferred embodiment are assembled into the exterior wall 30 in much the same way as the vertically aligned panels 50 in the shearwalls 11, 12 and described above. Except for the exterior bay panel 120A with couplers 308 located farthest to the left on FIG. 2, each of the four couplers 306 in each of the bay panels 120 is approximately 7⅝ inches long and coupled to a piece of #6 rebar, which is rebar that is about ¾ inches in diameter. The couplers 308 in the bay panel 120A on the left are 8⅝ inches long and coupled to #8 rebar. This bay panel 120A uses bigger couplers and rebars because it has greater strength requirements. Unlike the other bay panels 120, bay panel 120A is not directly coupled to vertical steel columns or shearwalls 12 or 13 nor to floor planks or framework walls located between the shearwalls 12 and 13. The top of each of the four couplers 306 is flush with the top edges 137 or 138 of the bay panel 120. A rebar 316 is coupled to each coupler 306 and runs vertically down through the bay panel 120 and extends vertically out from the bottom edges 143 and 144 of the columns 123 and 124 of the bay panel 120. In the case of each #6 rebar 316 coupled to a coupler 306, the rebar 316 extends approximately 7 inches beyond the bottom edges 143 and 144. The four rebars 308 project approximately 8 inches beyond the bottom edges (not shown) of the bay panel 120A.

In the first level of bay panels 120, the rebars 316 coupled to the couplers 306 in the bay panel 120 are arranged to fit into the couplers 306 already embedded in the foundation 20. Before each bay panel 120 is hoisted into place, shims, not shown, are placed on the foundation 20 near the location where each end of the bay panel 120 will be placed. The bay panel 120 is then hoisted onto the shims with the rebar 316 extending from the bottom edges 143 and 144 of the columns 123 and 124 of the bay panel 120 being inserted into the corresponding couplers 306 in the foundation 20. Each bay panel 120 has recessed lifting hooks (not shown) for hoisting the bay panel 120 into place. However, any variety of methods known to those skilled in the art to lift the bay panels 120 into place may be used. The voids in and surrounding the couplers, rebars, and lifting hooks are then grouted. A layer of grout 1 inch thick is also injected between the bay panel 120 and the foundation 20.

Each of the exterior flat panels 160 on the first level also has two #8 rebars (not shown in FIGS. 14 and 15) extending approximately 7 inches from its bottom edge 162. These rebars are centered between the inside face 166 and outside face 165 of the flat panel 160. One rebar is centered approximately 1 foot 11½ inches from one side edge 163 of the flat panel 160 and the other centered 1 foot 11½ inches from the second side edge 164 of the flat panel 160. The rebars are arranged to fit into sleeves approximately 3 inches in diameter and 8 inches long already embedded in 6-inch thick reinforced concrete 36 of the foundation 20 shown in FIG. 2. The tops 298 of the sleeves are shown in the reinforced concrete 36 in FIG. 2.

As with the bay panels 120, before each exterior flat panel 160 is hoisted into place, shims, not shown, are placed on the foundation 20 near the location where each edge 163 and 164 of the flat panel 160 will be placed. The flat panel 160 is then hoisted onto the shims with the rebar extending from the bottom of the flat panel 160 being inserted into the corresponding sleeves in the foundation 20. Again, each flat panel 160 has, recessed lifting hooks (not shown) for hoisting the flat panel 160 into place. Again, however, any variety of methods known to those skilled in the art to lift the flat panels 160 into place may be used. The voids in and surrounding the sleeves, rebars, and lifting hooks are then grouted. A layer of grout 1 inch thick is also injected between the flat panel 160 and the foundation 20.

For the bay panels 120 that are placed on the second level above the bay panels 120 of the first level already in place on the foundation 20, the rebars 316 in the bay panels 120 are arranged to fit into the couplers 306 of the bay panels 120 of the first level when the bay panels 120 for the second level are hoisted into place on the exterior wall 30. As with the shearwall panels 50 and the first level bay panels 120 on the foundation 20, before each bay panel 120 is hoisted into place, shims, not shown, are placed on the top edges 136 and 137 of the bay panel 120 already in place near the location where each of the side edges 123 and 124 of the bay panel 120 for the second level of the exterior wall 30 will be placed. The bay panel 120 to be placed on the second level is then hoisted onto the shims with the rebar 316 extending approximately 6 inches from the bottom edges 143 and 144 of the bay panel 120 being inserted into the corresponding couplers in the bay panel 120 already in place. The voids in and surrounding the couplers 306 and rebars 316 of the vertically aligned bay panels 120 are then grouted. A layer of grout approximately ½ inch thick is also injected between the bay panel 120 on the second level and the bay panel 120 on the level immediately below.

As noted above, rebar not shown in the drawings runs throughout the bay panel 120. However, certain pieces of rebar in the bay panel are shown in the figures to highlight the features that they bring to the invention. Embedded in column 123 of the bay panel 120 and projecting from its side edge 132 is an anchor 146 providing support for an adjacent flat exterior panel 160. A similar anchor 147 projects from the side edge 133 of column 124 of bay panel 120.

FIG. 23 is a detail elevation view of a portion of bay panel column 124 and flat panel 160 along edge 163 where flat panel 160 is coupled to anchor 147. The hardware of anchor 147 in the embodiment shown is comprised of a plate 170 that is approximately ⅜ inches thick, 5 inches wide and 8 inches long. The plate 170 has four approximately ½-inch diameter, 4-inch long studs 171 that are coupled to the face 172 of the plate 170. A #3 rebar 173 that is approximately 1 foot 6 inches long is also coupled to the face 172 of the plate 170. Coupled to the opposing face 174 of the plate is a tube 175 that is approximately ¼-inch thick, 3 inches wide, and 4 inches high. Centered along the top edge 176 of tube 175 is a slot (not shown) that is approximately ⅞ inches wide and 1½ inches long. The anchor 147 is precast into the concrete of bay panel column 124 such that the bottom edge 177 of tube 175 is located approximately 3½ inches from the bottom edge 144 of bay panel column 124. The face 174 of the plate 170 is proximately flush with the side edge 133 of bay panel column 124.

A void 178 is located in flat panel 160 where side edge 163, bottom edge 162, and inside face 166 of the flat panel 160 would otherwise meet. The void is approximately 4 inches long along bottom edge 162, 6½ inches high along side edge 163 and 4 inches deep from inside face 166. A sleeve 182 is cast into the flat panel 160. The sleeve 182 is comprised of a plate 183 that is approximately ⅜ inches thick, 4 inches wide and 4 inches long. An approximately ½-inch diameter, 5⅜-inch long stud 186 is centered on and runs through the plate 183. Approximately 4 inches of the stud 186 extends from the inside face 184 of plate 183 while approximately 1 inch of stud 186 extends from the outside face 185 of plate 183. Also coupled to the inside face 184 of plate 183 is a #3 rebar 187 that is approximately 1 foot 6 inches long. The sleeve 182 is cast into the flat panel such that the outside face 185 of the plate 183 lies along the edge,188 of flat panel 160 formed across the top of void 178. A mirror sleeve (not shown) of the sleeve 182 is located in the flat panel 160 where side edge 164 and bottom edge 162 meet along inside face 166. (See FIGS. 12 through 15.) The flat panel 160 is hoisted with sleeve 182 being placed on the anchor 147 of a bay panel column 124 that is already in place while the mirror sleeve is hoisted onto the anchor 146 of column 124 of another bay panel 120. There is an approximately ½-inch gap between the side edges 163 and 164 of the flat panel 160 and the side edges 133 and 132 of the corresponding bay panels 120. The 1-inch portion of stud 186 extending from the outside face 185 of plate 183 is inserted into the slot (not shown) in the top edge 176 of tube 175 in anchor 147 while the same is done with the corresponding 1-inch portion of the stud (not shown) of the mirror sleeve and anchor 146 of the other bay panel column 124. A shim stack 189 is used as necessary between the anchor 147 and the sleeve 182 and a second shim stack (not shown) between anchor 146 and the mirror sleeve to position flat panel 160 to the appropriate-level. The anchor 147 is then lightly welded to the sleeve 182 while the corresponding anchor 146 of the other column 124 of another bay panel 120 and the mirror sleeve is also lightly welded.

A second bracket 260 is then placed between bay panel column 124 and flat panel 160 as shown in FIG. 24. Two ¾-inch diameter threaded inserts 261 and 262 are precast into flat panel 160 on the inside face 166 while one ¾-inch diameter threaded insert 263 is precast into bay panel column 124 on the inside face 129. Threaded inserts 261 and 262 are centered approximately 3 inches from side edge 163 of flat panel 160. Threaded insert 261 is also centered approximately 4½ inches down from the top edge 161 of flat panel 160 while threaded insert 262 is centered approximately 7½ inches down from the top edge 161. Threaded insert 263 is centered approximately 3 inches from the side edge 133 of bay panel column 124 and approximately 4 feet ½ inch from the bottom edge 144 of bay panel column 124. A plate 264 is then placed over the threaded inserts 261, 262, and 263. The plate 264 is approximately ⅝ inches thick, 7 inches wide, and 10½ inches long and has three ⅞-inch slots 265 that correspond to the three threaded inserts 261, 262, and 263. Separate ¾-inch diameter, 4-inch long threaded rods 266 are then inserted through each of the slots 265 and into the threaded inserts 261, 262, and 263. Each threaded rod 266 is then capped with a ¾-inch washer (not shown) and ¾-inch hex nut 267. A corresponding second bracket (not shown) is similarly placed between the inside face 166 of flat panel 160 along side edge 164 and the inside face 128 of column 123 of the other bay panel 120.

The voids surrounding the anchor 147 and sleeve 182 and the corresponding anchor 146 and mirror sleeve, as well as the gaps between the side edges 163 and 164 of the flat panel 160 and the side edges 133 and 132 of the corresponding bay panels 120 are then grouted. This procedure of coupling bay panels 120 and flat panels 160 is repeated until a monolithic level of the reinforced concrete exterior wall is completed. Again, any variety of methods and fixtures known to those skilled in the art may be used to construct this monolithic level of reinforced concrete exterior wall.

In the embodiment shown, the bay panels 120 are coupled to an end shearwall 12 or 13, an internal framework wall 14 or 15, floor planks 210 (shown in FIG. 19), a vertical framework column 14 or 15, or some combination thereof, depending on the bay panel 120 location along the wall. As seen on the layout of FIG. 2, the end shearwalls 12 and 13 and internal framework walls 14 and 15 are arranged and the bay panels 120 configured such that a different bay panel column 123 or 124 straddles the side edge 17 or 18 of each shearwall 12 or 13, respectively, or the side edge 180 or 181 internal framework wall 14 or 15, respectively.

FIG. 16 is a side section view of two bay panel columns 124, the foundation 20 and the shearwall panel 51 level and the bottom portion of the shearwall panel 50 on one side 73 of the shearwall 13 along the line 4—4 of FIG. 11. Three brackets 190 coupling the two bay panel columns 124 to the shearwall 13 are also shown. The coupling of bay panel column 124 to shearwall panel 50 is representative of coupling of bay panel columns 123 or 124 to the other walls 12, 14 and 15. Included in the section view provided by FIG. 16 is the section view of three couplers 306 and portions of rebars 316 attached to the couplers 306 in the bay panel column 124. Not shown in FIG. 16 for clarity are the floor planks in the floor.

FIG. 17 is taken along line 12—12 of FIG. 11. FIG. 17 is a top plan section view of a portion of the bay panel .column 124, the shearwall 13, and a first bracket 190 coupling the bay panel column 124 to face 73 and a second bracket 190A coupling the bay panel column 124 to the face 74 of the panel 50 of the shearwall 13. FIG. 18 is a detail top plan section view of the portion designated by the dotted line 191 in FIG. 17. FIG. 18 shows one of the brackets 190A coupling the bay panel column 120 to the shearwall 13. For each bracket 190 or 190A, an approximately ⅜-inch by 6-inch by 6-inch plate 192 with two approximately ½-inch diameter by 4-inch studs 193 and 194 attached are cast into the shearwall 13. Each plate 192 has a threaded hole for a ¾ inch diameter threaded rod 195. An edge 196 of plate 192 is arranged along the side edge 18 of the shearwall 13. A face 197 of plate 192 is flush with the face 74 of the panel 50 of the shearwall 13. Two plates 192, one on each opposing face 73 and 74 of the panel 50, are centered approximately 1 foot from the bottom of the wall panel 50 and two plates 192, one on each opposing face 73 and 74 of the panel 50, are centered approximately 5 feet 11¾ inches from the bottom of the wall panel 50.

There are also four plates 200 embedded in the panel column 123 of the bay panel 120 that correspond to the four plates 192 in the shearwall 13. Each plate 200 in the panel column 123 is approximately ⅜ inches thick, 7 inches high, and 4 inches wide with four ½-inch diameter by 6-inch studs 201 attached. The face 202 of each plate 200 on the column panel 123 is flush with the face 128 of the column panel 123 facing the inside of the building. Each plate 200 has a threaded hole centered 4 inches from side edge 132 through which a 6-inch long, ¾-inch diameter threaded rod 198 is placed. Two plates 200 on the column panel 123 are centered approximately 5½ inches to one side of the centerline extending between the two side edges 132 and 134 of the panel column 123, while two plates 200 are centered 5 ½ inches to the opposite side of the centerline. The two lower plates 200 are centered approximately 3 feet 1 inch from the bottom edge 143 of the bay panel column 123 while the two higher plates 200 are centered approximately 1 foot from the top edge 137 of the bay panel column 123. Thus, there are four pairs of wall and panel column plates 192 and 200 whose horizontal centerlines are on the same horizontal plane. There is also a third plate 203 for each pair of wall and panel column plates 192 and 200 used in coupling each pair of plates 192 and 200 together. The third plate 203 is angled in an L-shape. Plate 203 is ⅜ inches thick, 6 inches wide, 4 inches long (L6×4×⅜) along inside face 128, and 6 inches long along face 74 of panel 50. Third plate 203 has a ⅞-inch by 3-inch slot (not shown) centered along each of its lengths. Third plate 203 is position such that a ¾-inch threaded rod 195 is run through the slot (not shown) along the 6-inch length of plate 203 and threaded into plate 192. Third plate 203 is also positioned so that a ¾-inch threaded rod 198 is similarly run through the slot (not shown) along the 4-inch length of plate 203 and threaded into plate 200. A shim stack 199 is placed as needed in the space between plate 203 and plate 200. Threaded rod 198 is then capped with a washer 198B and ¾-inch hex nut 198A while threaded rod 195 is likewise capped with a washer 205 and a ¾-inch hex nut 195A. The third plate 203 is then welded to the face 202 of the plate 200 thereby forming a bracket 190A coupling the panel column 123 to the panel 50 of shearwall 13. The same materials and procedures are followed for mounting each of the brackets 190 and 190A. Similarly, the same materials and procedures are used to couple the bay panel columns 123 and 124 to interior framework walls 14 and 15.

As noted above, there are locations along the interior framework where there is no end shearwall 12 or 13 or interior framework wall 14 or 15 for one or both bay panel columns 123 and 124 to be coupled to. In those instances, the bay panel column 123 or 124 is coupled to floor planks 210 with a bracket 209. FIG. 19 is the side section view of the portion of a bay panel column 123 or 124 coupled to floor planks 210 approximately 12 inches thick taken along line 13—13 of FIG. 2. There is also a 6-inch Corewall® slotted insert 217 centered along the horizontal axis of, and embedded in, the bay panel column 123 or 124. FIG. 22 is a perspective view of a slotted insert 217. The bottom of each slotted insert 217 is located approximately 2 feet from the bottom edge 143 or 144 of bay panel column 123 or 124 such that a threaded opening 218 may be properly aligned to accept a threaded rod 219 that is run through a slot (not shown) in angle plate 216. Angle plate 216 is configured similar to angle plate 203 coupling the bay panel column 123 to the panel 50 of shearwall 13. Indeed, in the embodiment shown, the coupling of the bay panel column 123 or 124 to the floor planks 210 is accomplished in much the same manner as the coupling of the bay panel column 123 panel 50 of shearwall 13.

The floor planks 210 may vary in material, size and shape depending on aesthetic and structural design requirements which are well known to those skilled in the art. The floor planks 210 used in the embodiment shown are generally 4 feet wide and either 12 inches or 8 inches thick, are made of reinforced concrete, and have hollow cores 211. Two of the planks 210 are drilled with separate holes above and into two of the hollow cores 211 in the planks 210. The hole closest to bay panel column 123 is large enough to accommodate a steel plate 212 approximately 12inches long, 6 inches wide, and ⅜ inches thick with four ½-inch diameter, 4-inch long studs attached. The hole farthest from bay panel column 123 is large enough to accommodate a steel plate 212A approximately 8 inches long, 4 inches wide, and ⅜ inches thick with two ½-inch diameter, 4-inch long studs attached. Studded steel plates 212 and 212A are placed into their respective holes so that the top surface 213 of the plate 212 and the top surface 213A of the plate 212A is flush with the top surface 214 of the planks 210.

The 8-inch long side edges of the plate 212 are arranged parallel with the inside face 128 of the panel column 123 of the exterior wall 30. One plate 212 is centered approximately 3 inches and the second plate 212A is centered approximately 4 feet 3 inches from the inside face 128 of the panel column 123. The holes and the hollow cores 211 under the holes are then filled with grout so that the plates 212 are secure in the planks 210. A strap plate 215 with a thickness ¼ inch, a width of 2 inches, and a length of 4 feet 6 inches is then welded to the plates 212 and 212A in the floor planks 210 thereby coupling the plates 212 and 212A. The corewall slotted insert 217 is then coupled to the plate 212 with an angle plate 216 in the same manner as plate 200 in bay panel 123 is coupled to plate 192 in panel 50 with angle plate 203 to form a secure bracket 209 between the exterior wall 30 and the floor planks 210. A top plan view of the coupling without the threaded rods, hex nuts, washers and shims is shown in FIG. 19A. Other materials and methods well known to those skilled in the art may be used to couple the vertical self-supporting reinforced concrete exterior wall to the floors of the adjoining structure.

In the embodiment described,:brackets 190, 190A and 209 bolted to both the exterior wall and the adjoining framework couple the exterior wall 30 to the adjoining framework. However, the exterior wall 30 may be coupled to the adjoining framework of the structure by any number of means known to those skilled in the art. For example, the exterior wall 30 may be coupled to the end shearwalls 12 or 13 or the interior framework walls 14 and 15 using hairpin rebar and grout in the same manner as the end shearwall 13 was coupled to the center shearwall 11 as described above. However, as noted above, a benefit of a vertically self-supporting exterior wall 30 is the bomb-proofing it provides to the interior framework. The vertically self-supporting nature of the exterior wall 30 permits the exterior wall 30 to absorb the shock of a bomb blast while insulating the internal structure of the building from the blast. The use of the brackets 190, 190A and 209 permits the exterior wall 30 to more freely break away and collapse from a bomb blast while leaving from the remaining structure, including any persons occupying the structure at the blast, relatively intact.

In the preferred embodiment of the invention, the exterior wall 30 is coupled to reinforced concrete components of the shearwalls 12 and 13, interior walls 14 and 15, and/or floor planks 210. In other embodiments the exterior wall may be similarly coupled to reinforced concrete columns and beams. Likewise, in the preferred embodiment, the lateral support for the exterior wall 30 is derived directly and indirectly from the interior shearwalls 11, 12 and 13 forming an "H," "I" or "C" configuration described above. However, the vertically self-supporting exterior wall 30 may derive its lateral support from any variety of framework designs known to those skilled in the art to impart lateral support for adjoining framework.

For purposes of showing the variety of forms the invention may take, part of the exterior wall 30 in the embodiment shown is also coupled to vertical steel columns 220 and 221 embedded in the foundation 20. FIG. 20 is a detail top plan section view of an exterior wall panel 120 coupled to the two steel columns 220 and 221 located toward the right side of and along the exterior wall 30 shown in FIG. 2. The steel in the columns 220 and 221 range from W14×233 on the first floor to W14×48 near the roof of the building depending on the load requirements of the building. Determination of load support requirements is standard practice and well known to those skilled in the art. Similarly, design of the steel columns, such as steep columns 220 and 221, to support those load requirements is also well known.

FIG. 21 is a side elevation view of a representative bracket 230 between one of the steel columns 220 and 221 and the bay panel columns 123 and 124 within the dotted line 222 in FIG. 20.

As viewed from the plan view of FIG. 20 looking down the vertical length of the steel columns 220 and 221, each steel column 220 and 221 is in the shape of an "H." The side bars 223 and 224 of the "H" are parallel to the vertical plane of the exterior wall 30. The center line running perpendicularly through the center bar 225 of the "H" is located approximately 10 inches from the interior face 128 of the bay panel column 123. Horizontal beams connected to the steel columns 220 and 221 as well as to other parts of the internal framework of the building and floors, in this case comprised of floor planks, are not shown. The materials and construction methods to construct internal framework coupled to steel columns and to construct floors is well known to those skilled in the art.

A 13⁄16-inch hole (not shown) is drilled through side bar 223 on both sides of center bar 225. The holes are centered to align with the horizontal centerline of two slotted inserts 217 centered approximately 1 foot below the top edge 137 of bay panel column 123. The vertical centerline of one slotted insert 217 is centered approximately 9 inches from the vertical centerline of bay panel column 123 while the second slotted insert 217 is centered approximately the same 9-inch distance from vertical centerline on the opposite side. Each of the 13⁄16-inch holes is centered approximately 2¾ inches on opposite sides of the center line of center bar 225. A C-channel 231 that is 6 by 10.5 (C6×10.5) and 22 inches long and has four ⅞-inch slots (not shown) is placed against the face 232 of side bar 223 closest to bay panel column 123. Two of the slots are configured in the C-channel 231 to align with the two 13⁄16-inch holes drilled through side bar 223. The remaining two slots are configured to align with the vertical and horizontal centerlines of the two slotted inserts 217. The C-channel 231 is then bolted with ¾-inch diameter bolts 233, washers (not shown) and hex nuts 234. A bolt 236 is run through each of the remaining two slots and into the threaded portions 218 of slotted inserts 217. A ¾-inch hex nut 237 and washer 238 on each of the bolts 236 are tightened against the slotted insert 217 while another ¾-inch hex nut 237 and washer 238 on each of the bolts 236 are tightened against the inside face 232 of C-channel 231 to complete the bracket 230. A second bracket 230 is centered 2 feet 3½ inches from the bottom of each of the bay panel columns 123 and 123 running along steel columns 220 and 221. Once coupled, the space between the bay panel 120 and the floor panels 210 and steel columns 220 and 221 are grouted.

In this embodiment of the exterior wall 30, as in other parts of the exterior wall 30, the bay panels 123 and 124 are vertically aligned along the steel beams 220 and 221 so that the non-load supporting floor 140 of the bay panels 120 align with the floors of the structure providing lateral support for the vertically self-supporting exterior wall.

As evident from the foregoing description, as long as the framework coupled to the exterior wall is vertically self-supporting and provides lateral support for the exterior wall, the methods of building the exterior wall either using pre-fabricated reinforced concrete panels or setting the rebars and casting the concrete on-site are the same regardless of the design and materials that may be used. Only the material and methods of coupling the exterior wall to the adjoining structure providing lateral support to the exterior wall differs. Yet, even then, any standard materials and methods well known to those skilled in the art may be used to accomplish this task.

In the embodiment shown, after coupling of the bay panels 120 to the framework of the structure providing lateral support is completed on one level, or floor, of the structure, the space between the now formed exterior wall 30 and the framework providing lateral support is then grouted This will include grouting between the exterior wall 30 and the adjacent shearwall 12 and 13 and interior framework wall side edges 180 and 181 as well as the adjacent floor planks 210 and vertical steel columns 220 and 221. This procedure will include grouting the space between the edge of the building's floor planks 210 next to the exterior panels 120 and 160 and the side edge 141 of the non-load bearing floor 140 in the bay panels 120.

The process described above will be repeated level by level, or floor by floor, until the desired height of the vertically self-supporting exterior wall 30 and the framework providing lateral support for the exterior wall 30 is achieved. A roof structure, not shown, is then built onto to the structure, including the vertically self-supporting exterior wall 30, thereby completing the building.

The inventions set forth above are subject to many modifications and changes without departing from the spirit, scope or essential characteristics thereof. Thus, the embodiments explained above should be considered in all respects as being illustrative rather than restrictive of the scope of the inventions, as defined in the appended claims.

What is claimed is:

1. A multi-story building comprising:

(a) a foundation;

(b) a supporting framework coupled to the foundation, wherein the supporting framework comprises:

(1) a central rectangular shearwall, (2) a first rectangular end shearwall, (3) a second rectangular end shearwall, and (4) plurality of spaced apart floors arranged in a substantially parallel manner relative to each other and the foundation, and wherein:

(5) each shearwall includes a top edge, a bottom edge, and two opposing side edges, the edges defining first and second opposing faces, and each shearwall forming a vertical support plane;

(6) each floor includes at least three side edges, the edges defining a top face and an opposing bottom face, and each floor forming a horizontal support plane wherein each floor is coupled to at least two of the shearwall;

(7) the bottom of each shearwall is coupled to and supported by the foundation;

(8) the vertical support plane of each shearwall is aligned substantially normal to the foundation;

(9) the central shearwall is coupled proximate the first side edge to the first end shearwall;

(10) the central shearwall is coupled proximate its second side edge to the second end shearwall; and

(11) the central rectangular shearwall, the first rectangular end shearwall and the second rectangular end shearwall in cooperation provide all necessary lateral support for the building and -all necessary vertical support for the floors of the building; and (c) at least one vertically self-supporting exterior wall that is vertically self-supporting along a vertical support plane, the vertically self-supporting exterior wall including a top vertical wall edge, a bottom vertical wall edge, and two opposing vertical wall side edges, the vertical wall edges defining first and second vertical wall opposing faces, and the vertically self-supporting exterior wall coupled to the foundation and coupled to the supporting framework, wherein the supporting framework provides all necessary lateral support for the vertically self-supporting exterior wall.

2. The building of claim 1 wherein the end shearwall are arranged substantially normal to the central shearwall.

3. The building of claim 1 wherein there are multiple central rectangular shearwall.

4. The building of claim 1 wherein at least each of the end shearwalls is comprised of proximate to the central shearwall approximately equidistant from the two side edges of the end shearwall.

5. The building of claim 1 wherein at least one of the shearwalls is comprised of reinforced concrete.

6. The building of claim 5 wherein at least part of the reinforced concrete shearwall is monolithic along its vertical support plane from the foundation to proximate the top edge of the shearwall.

7. The building of claim 6 wherein each reinforced concrete shearwall further comprises at least one line of rebar running continuously from the bottom edge of the shearwall to proximate the top edge of the shearwall.

8. The building of claim 7 wherein the continuous rebar in the reinforced concrete shearwall comprises multiple individual pieces of rebar relatively aligned end-to-end and coupled at their respective aligned ends.

9. The building of claim 8 further comprising a coupler physically joining the relatively aligned ends of the individual pieces of rebar in the reinforced concrete shearwall.

10. The building of claim 7 wherein the reinforced concrete shearwall comprises a plurality of individual reinforced concrete panels aligned substantially normal to the foundation, and wherein each panel is defined by at least three perimeter edges and at least one substantially vertical face.

11. The building of claim 10 wherein the reinforced concrete shearwall further comprises a plurality of panel joints joining at least a portion of a perimeter edge of each panel to at least a portion of a perimeter edge of an adjacent panel.

12. The building of claim 11 wherein at least two panels are arranged in a vertically adjacent manner, and wherein a panel joint between the two vertically adjacent panels comprises:

(a) at least one piece of rebar running between and joining the adjacent perimeter edges of the vertically adjacent panels and wherein the rebar is aligned normal to the foundation and parallel to the opposing faces defined by the panels; and (b) a layer of grout sealing the joint.

13. The building of claim 12 wherein at least two panels in the reinforced concrete shearwall are arranged in a horizontally adjacent manner, and wherein a panel joint coupling the two horizontally adjacent panels comprises a layer of grout between the panels sealing the joint.

14. The building of claim 13 wherein the panel joint coupling the horizontally adjacent panels further comprises a bracket coupling together the two horizontally aligned panels.

15. The building of claim 3 wherein the panel joint coupling the vertically adjacent panels further comprises a bracket coupling together the two vertically aligned panels.

16. The building of claim 3 wherein the panel joint coupling the horizontally adjacent panels further comprises at least one piece, of rebar running from one of the horizontally adjacent panels into the panel joint.

17. The building of claim 3 wherein the panel joint coupling the horizontally adjacent panels further comprises at least one piece of rebar running from one of the horizontally adjacent panels into the panel joint and hooking in the panel joint.

18. The building of claim 3 wherein the panel joint coupling the horizontally adjacent panels further comprises at least one piece of rebar running from one of the panels through the layer of grout and into the second panel.

19. The building of claim 1 further comprises at least three exterior walls, and wherein at least one of the exterior walls is one of the end shearwalls.

20. The building of claim 1 further comprises a dependent framework, and wherein the dependent framework comprises:

(a) the floors;

(b) a plurality of horizontally oriented beams arranged in a spaced apart manner and coupled to and horizontally supporting the floors;

(c) a plurality of vertically oriented columns arranged in a spaced-apart manner and coupled to and vertically supporting the beams;

(d) a plurality of vertically oriented dependent walls coupled between the floors;

(e) at least one vertically oriented outside wall coupled to and supported by the foundation and coupled to a plurality of the floors; and wherein (f) each dependent wall and each outside wall includes a top edge, a bottom edge, and two opposing side edges, the edges defining first and second opposing faces.

21. The building of claim 20 wherein at least one of the columns is comprised of reinforced concrete.

22. The building of claim 20 wherein at least one of the beams is comprised of reinforced concrete.

23. The building of claim 20 wherein at least one of the floors is comprised of reinforced concrete.

24. The building of claim 21 wherein at least one of the floors is comprised of reinforced concrete planks.

25. The building of claim 24 wherein at least one of the planks is hollow.

26. The building of claim 20 wherein at least one of the shearwalls is comprised of reinforced concrete.

27. The building of claim 26 wherein at least part of the reinforced concrete shearwall is monolithic along its vertical support plane from the foundation to proximate the top edge of the shearwall.

28. The building of claim 27 wherein at least one of the dependent walls has at least one opening extending from one face of the dependent wall to the opposing face of the dependent wall.

29. The building of claim 20 wherein at least one of the columns and one of the beams are comprised of reinforced concrete.

30. The building of claim 29 wherein at least one of the floors is comprised of reinforced concrete.

31. The building of claim 29 wherein at least one of the shearwalls is comprised of reinforced concrete.

32. The building of claim 26 wherein at least one shearwall has at least one opening extending from one face of the shearwall to the opposing face of the shearwall.

33. The building of claim 32 wherein at least one of the columns is comprised of reinforced concrete.

34. The building of claim 32 wherein at least one of the beams is comprised of reinforced concrete.

35. The building of claim 32 wherein at least one of the floors is comprised of reinforced concrete.

36. The building of claim 32 wherein at least one of the floors is comprised of reinforced concrete planks.

37. The building of claim 36 wherein at least one of the planks is hollow.

38. The building of claim 32 wherein at least one of the dependent walls is comprised of reinforced concrete.

39. The building of claim 38 wherein at least part of the reinforced concrete shearwall is monolithic along its vertical support plane from the foundation to proximate the top edge of the shearwall.

40. The building of claim 39 wherein at least one of the dependent walls has at least one opening extending from one face of the dependent wall to the opposing face of the dependent wall.

41. The building of claim 32 wherein at least one of the columns, at least one of the beams, at least one of the floors, at least one of the dependent walls, and the exterior wall are comprised of reinforced concrete.

42. The building of claim 32 wherein at least one of the columns, at least one of the beams, at least one of the dependent walls, and the exterior wall are comprised of reinforced concrete and wherein the floors is comprised of reinforced concrete planks.

43. The building of claim 32 wherein at least one of the columns, at least one of the beams, at least one of the dependent wall, at least one of the outside wall, and the exterior wall are comprised of reinforced concrete and wherein at least one of the floors is comprised of hollow reinforced concrete planks.

44. The structure of claim 20 wherein the shearwalls are comprised of reinforced concrete.

45. The building of claim 44 wherein at least part of each reinforced concrete shearwall is monolithic along its vertical support plane from the foundation to proximate the top edge of the shearwall.

46. The building of claim 45 wherein each reinforced concrete shearwall further comprises at least one line of rebar running continuously from the bottom edge of the shearwall to proximate the top edge of the shearwall.

47. The building of claim 46 wherein the continuous rebar in each reinforced concrete shearwall comprises multiple individual pieces of rebar relatively aligned end-to-end and coupled at their respective aligned ends.

48. The building of claim 47 further comprising a coupler physically joining the relatively aligned ends of the individual pieces of rebar in the reinforced concrete shearwalls.

49. The building of claim 46 wherein each of the reinforced concrete shearwall comprises a plurality of individual reinforced concrete panels aligned substantially normal to the foundation, and wherein each panel is defined by at least three perimeter edges and at least one substantially vertical face.

50. The building of claim 49 wherein each of reinforced concrete shearwall is further comprised of a plurality of panel joints joining at least a portion of a perimeter edge of each panel to at least a portion of a perimeter edge of an adjacent panel.

51. The building of claim 50 wherein at least two panels in each of the reinforced concrete shearwall are arranged in a vertically adjacent manner, and wherein a panel joint between the two vertically adjacent panels comprises:

(a) at least one piece of rebar running between and joining the adjacent perimeter edges of the vertically adjacent panels and wherein the rebar is aligned normal to the foundation and parallel to the opposing faces defined by the panels; and (b) a layer of grout sealing the joint.

52. The buildings of claim 51 wherein at least two panels in each of the reinforced concrete shearwall are arranged in a horizontally adjacent manner, and wherein a panel joint coupling the two horizontally adjacent panels comprises a layer of grout between the panels sealing the joint.

53. The building of claim 52 wherein each shearwall has at least one opening extending from one face of the shearwall to the opposing face of the shearwall.

54. The building of claim 53 wherein the columns, the beams, the dependent walls, the exterior wall, the outside wall and the floors are comprised of reinforced concrete.

55. The building of claim 46 wherein the exterior wall is comprised of reinforced concrete.

56. The building of claim 55 wherein each reinforced concrete exterior wall further comprises at least one line of rebar running continuously from the bottom edge of the exterior wall to proximate the top edge of the exterior wall.

57. The building of claim 56 wherein the continuous rebar in each reinforced concrete exterior wall comprises multiple individual pieces of rebar relatively aligned end-to-end and coupled at their respective aligned ends.

58. The building of claim 57 further comprising a coupler physically joining the relatively aligned ends of the individual pieces of rebar in each reinforced concrete exterior wall.

59. The building of claim 56 further comprising dependent framework joints coupling each reinforced concrete exterior wall to the dependent framework of the building adjacent to the exterior wall.

60. The building of claim 59 wherein at least one reinforced concrete exterior wall is coupled to at least one of the end shearwalls.

61. The building of claim 59 wherein at least one of the dependent framework joints comprises a bracket.

62. The building of claim 59 wherein at least one of the dependent framework joints comprises a layer of grout.

63. The building of claim 62 wherein at least one of the dependent framework joints further comprises a bracket.

64. The building of claim 60 further comprising dependent shearwall joints coupling the reinforced concrete exterior wall to at least one end shearwall.

65. The building of claim 64 wherein at least one of the dependent shearwall joints comprises a bracket.

66. The building of claim 64 wherein at least one of the dependent framework joints comprises a layer of grout.

67. The building of claim 66 wherein at least one of the dependent.

68. The building of claim 66 wherein the panel joint coupling two horizontally adjacent panels in the reinforced concrete shearwall further comprises at least one framework joints further comprises a bracket. piece of rebar running from one of the panels through the layer of grout and into the second panel.

69. The building of claim 67 wherein the panel joint coupling two horizontally adjacent panels in the reinforced concrete shearwall further comprises at least one piece of rebar running from one of the panels through the layer of grout and into the second panel.

70. The building of claim 56 wherein at least one exterior reinforced concrete wall further comprises a plurality of individual reinforced concrete panels aligned substantially normal to the foundation, and wherein each panel is defined by at least three perimeter edges and at least one substantially vertical face.

71. The building of claim 70 wherein the exterior reinforced concrete wall further comprises a plurality of panel joints joining at least a portion of a perimeter edge of each panel to at least a portion of a perimeter edge of an adjacent panel.

72. The building of claim 71 wherein at least two panels in the exterior reinforced concrete wall are arranged in a vertically adjacent manner, and wherein a panel joint between the two vertically adjacent panels comprises:

(a) at least one piece of rebar running between and joining the adjacent perimeter edges of the vertically adjacent panels and wherein the rebar is aligned normal to the foundation and parallel to the opposing faces defined by the panels; and (b) a layer of grout sealing the joint.

73. The building of claim 72 wherein at least two panels in the exterior reinforced concrete wall are arranged in a horizontally adjacent manner, and wherein a panel joint coupling the two horizontally adjacent panels comprises a layer of grout between the panels sealing the jot.

74. The building of claim 73 further comprising dependent framework joints coupling the reinforced concrete exterior wall to the dependent framework of the building adjacent to the exterior wall.

75. The building of claim 74 wherein at least one reinforced concrete exterior wall is coupled to at least one of the end shearwalls.

76. The building of claim 74 wherein at least one of the dependent framework joints comprises a bracket.

77. The building of claim 74 wherein at least one of the dependent framework joints comprises a layer of grout.

78. The building of claim 77 wherein at least one of the dependent framework joints further comprises a bracket.

79. The building of claim 75 further comprising dependent shearwall joints coupling the reinforced concrete exterior wall to at least one end shearwall.

80. The building of claim 79 wherein at least one of the dependent shearwall joints comprises a bracket.

81. The building of claim 79 wherein at least one of the dependent shearwall joints comprises a layer of grout.

82. The building of claim 81 wherein at least one of the dependent shearwall joints further comprises a bracket.

83. The building of claim 81 wherein the panel joint coupling two horizontally adjacent panels in the exterior reinforced concrete shearwall further comprises a bracket coupling together the two horizontally aligned panels.

84. The building of claim 79 wherein the panel joint coupling two horizontally adjacent panels in the exterior reinforced concrete shearwall further comprises a bracket coupling together the two horizontally aligned panels.

85. The building of claim 73 wherein the panel joint coupling two horizontally adjacent panels in the exterior reinforced concrete wall further comprises a bracket coupling together the two horizontally aligned panels.

86. The building of claim 54 wherein the exterior reinforced concrete walls has at least one opening extending from one face of the exterior wall to the opposing face of the exterior wall.

87. The building of claim 56 wherein the exterior wall includes a portion that projects out from the outside face of the exterior wall relative to the vertical support plane.

88. The building of claim 56 wherein the exterior wall includes a portion that projects out from the inside face of the exterior wall relative to the vertical support plane.

89. The building of claim 55 wherein each reinforced concrete exterior wall further comprises at least one line of rebar running continuously from the bottom edge of each of the exterior wall to proximate the top edge of the exterior wall.

90. The building of claim 89 wherein the continuous rebar in the exterior wall comprises multiple individual pieces of rebar relatively aligned end-to-end and coupled at their respective aligned ends.

91. The building of claim 90 further comprising a coupler physically joining the relatively aligned ends of the individual pieces of rebar in the exterior wall.

92. The building of claim 89 further comprising dependent framework joints coupling each of the reinforced concrete exterior walls to the dependent framework of the building adjacent to the exterior wall.

93. The building of claim 92 wherein at least one of the reinforced concrete exterior walls is coupled to at least one of the end shearwalls.

94. The building of claim 93 further comprising dependent shearwall joints coupling the reinforced concrete exterior wall to the end shearwall.

95. The building of claim 94 wherein at least one of the dependent shearwall joints comprises a bracket.

96. The building of claim 94 wherein at least one of the dependent shearwall joints comprises a layer of grout.

97. The building of claim 96 wherein at least one of the dependent framework joints further comprises a bracket.

98. The building of claim 97 wherein the panel joint coupling two horizontally adjacent panels the exterior reinforced concrete wall further comprises at least one piece of rebar running from one of the panels through the layer of grout and into the second panel.

99. The building of claim 96 wherein the panel joint coupling two horizontally adjacent panels the exterior reinforced concrete wall further comprises at least one piece of rebar running from one of the panels through the layer of grout and into the second panel.

100. The building of claim 92 wherein at least one of the dependent framework joints comprises a bracket.

101. The building of claim 92 wherein at least one of the dependent framework joints comprises a layer of grout.

102. The building of claim 101 wherein at least one of the dependent framework joints further comprises a bracket.

103. The building of claim 89 wherein the exterior reinforced concrete wall comprises a plurality of individual reinforced concrete panels aligned substantially normal to the foundation, and wherein each panel is defined by at least three perimeter edges and at least one substantially vertical face.

104. The building of claim 103 wherein the exterior reinforced concrete wall further comprises a plurality of panel joints joining at least a portion of a perimeter edge of each panel to at least a portion of a perimeter edge of an adjacent panel.

105. The building of claim 104 wherein at least two panels in the exterior reinforced concrete wall are arranged in a vertically adjacent manner, and wherein a panel joint between the two vertically adjacent panels comprises:

(a) at least one piece of rebar running between and joining the adjacent perimeter edges of the vertically adjacent panels and wherein the rebar is aligned normal to the foundation and parallel to the opposing faces defined by the panels; and (b) a layer of grout sealing the joint.

106. The building of claim 105 wherein at least two panels in the exterior reinforced concrete wall are arranged in a horizontally adjacent manner, and wherein a panel joint coupling the two horizontally adjacent panels comprises a layer of grout between the panels sealing the joint.

107. The building of claim 106 further comprising dependent framework joints coupling the reinforced concrete exterior wall to the dependent framework of the building adjacent to the exterior wall.

108. The building of claim 107 wherein the reinforced concrete exterior wall is coupled to at least one of the end shearwall.

109. The building of claim 108 further comprising dependent shearwall joints coupling the reinforced concrete exterior wall to at least one end shearwall.

110. The building of claim 109 wherein at least one of the dependent shearwall joints comprises a bracket.

111. The building of claim 109 wherein at least one of the dependent shearwall joints comprises a layer of grout.

112. The building of claim 111 wherein at least one of the dependent shearwall joints further comprises a bracket.

113. The building of claim 109 wherein the panel joint coupling two horizontally adjacent panels in each of the exterior reinforced concrete wall further comprises a bracket coupling together the two horizontally aligned panels.

114. The building of claim 111 wherein the panel joint coupling two horizontally adjacent panels in each of the exterior reinforced concrete wall further comprises a bracket coupling together the two horizontally aligned panels.

115. The building of claim 103 wherein the columns, the beams, the dependent walls, and the floors are comprised of reinforced concrete.

116. The building of claim 104 wherein the columns, the beams, the dependent walls, and the floors are comprised of reinforced concrete.

117. The building of claim 106 wherein the panel joint coupling two horizontally adjacent panels in each of the exterior reinforced concrete wall further comprises a bracket coupling together the two horizontally aligned panels.

118. The building of claim 107 wherein at least one of the dependent framework joints comprises a bracket.

119. The building of claim 107 wherein at least one of the dependent framework joints comprises a layer of grout.

120. The building of claim 119 wherein at least one of the dependent framework joints further comprises a bracket.

121. The building of claim 89 wherein the exterior wall has at least one opening extending from one face of the exterior wall to the opposing face of the exterior wall.

122. The building of claim 121 wherein the columns, the beams, the dependent walls, and the floors are comprised of reinforced concrete.

123. The building of claim 121 wherein the exterior wall includes a portion that projects out from the outside face of the exterior wall relative to the vertical support plane.

124. The building of claim 123 wherein the columns, the beams, the dependent walls, and the floors are comprised of reinforced concrete.

125. The building of claim 89 wherein each of the exterior wall includes a portion that projects out from the outside face of the exterior wall relative to the vertical support plane.

126. The building of claim 89 wherein the exterior wall includes a portion that projects out from the inside face of the exterior wall relative to the vertical support plane.

127. The building of claim 89 wherein columns, the beams, the dependent walls, and the floors are comprised of reinforced concrete.

128. A method of constructing a vertically sellf-supporting reinforced concrete wall of a structure comprising the step of:

(a) constructing one level of a network of interior building supports and walls on a foundation (b) hoisting a plurality of individual exterior reinforced concrete wall panels wherein each panel is defined by at least three perimeter edges and at least one substantially vertical face;

(c) arranging the exterior wall panels normal to the foundation and edge-to-edge over the foundation and next to the interionr network to form a row of panels wherein at least one edge of each panel is adjacent to at least one edge of another panel;

(d) coupling the row of panels to the foundation and coupling the adjacent edges of the panels to each other and further coupling the panels to the interior network to form a first level of an exterior wall including a substantially horizontal top edge;

(e) constructing another level of the interior network onto and above the existing interior network;

(f) arranging an additional plurality of individual exterior reinforced concrete wall panels normal to the foundation and edge-to-edge and along the horizontal top edge of the existing level of the exterior wall to form an additional row of panels;

(g) coupling the row of panels to the existing level of the exterior wall and coupling the adjacent edges of the panels to each other and coupling the panels to the interior network to form an additional level of an exterior wall; and (h) repeating steps (e) through (g) until the desired height of the exterior wall is achieved.

129. A method of constructing a multi-story structure comprising the steps of:

(a) constructing an internal supporting framework comprising the steps of:

(1) hoisting a plurality of prefabricated vertically self-supporting reinforced concrete panels wherein each panel is defined by at least three perimeter edges and at least one substantially vertical face;

(2) arranging the panels normal to a foundation and edge-to-edge over the foundation to form at least one row of panels wherein at least one edge of each panel in a row is adjacent to at least one edge of another panel in the row;

(3) coupling the panels to the foundation and coupling the adjacent panel edges to each other to form at least one center shearwall wherein each center shearwall includes a top edge, a bottom edge, and two opposing side edges, the edges defining first and second opposing faces, and wherein each center shearwall includes a vertical support plane substantially normal to the foundation, and wherein each bottom shearwall edge is coupled to and supported by the foundation;

(4) arranging an additional plurality of panels normal to the foundation and edge-to-edge over the foundation to form a row of panels wherein at least one edge of each panel is adjacent to at least one edge of another panel, and wherein the row of panels is adjacent to a first side edge of each center shearwall;

(5) coupling the additional panels to the foundation and coupling the adjacent panel edges to each other to form a first side shearwall wherein the side shearwall includes a top edge, a bottom edge, and two opposing side edges, the edges defining first and second opposing faces, and wherein the first side shearwall includes a vertical support plane substantially normal to the foundation, and wherein the bottom shearwall edge is coupled to and supported by the foundation;

(6) further coupling each center shearwall proximate the first side edge of the center shearwall to the first end shearwall;

(7) arranging an additional plurality of panels normal to the foundation and edge-to-edge over the foundation to form a row of panels wherein at least one edge of each panel is adjacent to at least one edge of another panel, and wherein the row of panels is adjacent to a second side edge of each center shearwall;

(8) coupling the additional panels to the foundation and coupling the adjacent panel edges to each other to form a second side shearwall wherein the second side shearwall includes a top edge, a bottom edge, and two opposing side edges, the edges defining first and second opposing faces, and wherein the second side shearwall includes a vertical support plane substantially normal to the foundation, and wherein the bottom shearwall edge is coupled to and supported by the foundation;

(9) further coupling each center shearwall proximate the second side edge of the center shearwall to the second end shearwall;

(10) constructing one level of a network including interior building supports and wall and coupling the network to the shearwall and foundation;

(11) coupling one level of at least one floor onto the shearwall and the network;

(12) arranging an additional plurality of panels normal to the foundation and edge-to-edge over and along the top edge of the shearwall;

(13) coupling the additional panels to the top edge of the shearwall and coupling the adjacent panel edges to each other;

(14) constructing another level of a network including interior building supports and wall onto the existing shearwall and existing network and onto and above existing floor;

(15) repeating steps (11) through (14) until a desired height of the shearwall is achieved; and (b) constructing at least one vertically self-supporting exterior wall comprising the steps of:

(1) arranging an additional plurality of panels normal to the foundation and edge-to-edge over the foundation to form a row of panels wherein at least one edge of each panel is adjacent to at least one edge of another panel and wherein the row of panels is adjacent to the internal supporting framework;

(2) coupling the additional panels to the foundation and coupling the adjacent panel edges to each other to form a vertically self-supporting exterior wall wherein the exterior wall includes a top edge, a bottom edge, and two opposing side edges, the edges defining first and second opposing faces, and wherein the exterior wall includes a vertical support plane substantially normal to the foundation and wherein the bottom exterior wall edge is coupled to and supported by the foundation;

(3) coupling the exterior wall to the internal supporting framework proximate the first side edge of the first exterior wall;

(4) arranging an additional plurality of panels normal to the foundation and edge-to-edge over and along the top edge of the exterior wall;

(5) coupling the additional panels to the top edge of the exterior wall and coupling the adjacent panel edges to each other;

6) further coupling the exterior wall to the internal supporting framework proximate the first side edge of the first exterior wall; and (7) repeating steps (4) through (6) until a desired height of the first exterior wall is achieved.

* * * * *